US009542908B2

(12) United States Patent
Ozawa et al.

(10) Patent No.: US 9,542,908 B2
(45) Date of Patent: *Jan. 10, 2017

(54) CHARACTER HIGHLIGHTING CONTROL APPARATUS, DISPLAY APPARATUS, HIGHLIGHTING DISPLAY CONTROL METHOD, AND COMPUTER PROGRAM

(71) Applicant: Sony Corporation, Tokyo (JP)

(72) Inventors: Atsushi Ozawa, Kanagawa (JP); Mitsuru Tada, Kanagawa (JP)

(73) Assignee: Sony Corporation, Tokyo (JP)

( * ) Notice: Subject to any disclaimer, the term of this patent is extended or adjusted under 35 U.S.C. 154(b) by 197 days.

This patent is subject to a terminal disclaimer.

(21) Appl. No.: 14/326,200

(22) Filed: Jul. 8, 2014

(65) Prior Publication Data

US 2014/0320517 A1 Oct. 30, 2014

Related U.S. Application Data

(60) Continuation of application No. 13/864,772, filed on Apr. 17, 2013, now Pat. No. 8,743,147, which is a (Continued)

(30) Foreign Application Priority Data

Apr. 28, 2006 (JP) ..... 2006-127090

(51) Int. Cl.
*G09G 5/02* (2006.01)
*G09G 5/10* (2006.01)
(Continued)

(52) U.S. Cl.
CPC ..... *G09G 5/02* (2013.01); *G09G 5/024* (2013.01); *G09G 5/10* (2013.01); *G09G 5/24* (2013.01); *G09G 3/3208* (2013.01); *G09G 2320/0238* (2013.01); *G09G 2320/0276* (2013.01); *G09G 2320/0686* (2013.01)

(58) Field of Classification Search
CPC ..... G09G 5/24; G09G 5/28
See application file for complete search history.

(56) References Cited

U.S. PATENT DOCUMENTS 5,963,704 A 10/1999 Mimura et al.
6,229,523 B1 5/2001 Czako
(Continued)

FOREIGN PATENT DOCUMENTS

JP 8-320679 A 12/1996
JP 2000-242255 A 9/2000
(Continued)

OTHER PUBLICATIONS

Korean Office Action issued Aug. 19, 2015 for corresponding Korean Application No. 10-2014-0153715.
(Continued)

*Primary Examiner* — Jeffery A Brier
(74) *Attorney, Agent, or Firm* — Michael Best & Friedrich LLP

(57) ABSTRACT

The present invention provides a character highlighting control apparatus including a character pixel extractor and a highlighting degree controller. The character pixel extractor is configured to extract a pixel corresponding to a character part from input image data. The highlighting degree controller is configured to carry out control in such a way that a maximum emission luminance of a display device is linked with input image data, to thereby selectively increase an emission luminance of an extracted pixel on a display screen and avoid increase of an emission luminance of a background part on the display screen.

20 Claims, 24 Drawing Sheets

Related U.S. Application Data continuation of application No. 13/739,499, filed on Jan. 11, 2013, now Pat. No. 8,791,961, which is a division of application No. 11/790,134, filed on Apr. 24, 2007, now Pat. No. 8,373,726.

(51) Int. Cl.

| | |
|---|---|
| ***G09G 5/24*** | (2006.01) |
| ***G09G 3/3208*** | (2016.01) |
| *G09G 3/32* | (2016.01) |

(56) References Cited

U.S. PATENT DOCUMENTS

| | | | | |
|---|---|---|---|---|
| 6,373,984 | B1 | 4/2002 | Gouge et al. | |
| 6,385,351 | B1 | 5/2002 | Simske et al. | |
| 2006/0082566 | A1 | 4/2006 | Akimoto et al. | |
| 2007/0139373 | A1* | 6/2007 | Simon | G06F 1/1626 345/157 |

FOREIGN PATENT DOCUMENTS

| | | | |
|---|---|---|---|
| JP | 2002-354238 | A | 12/2002 |
| JP | 2004-172879 | A | 6/2004 |
| JP | 2006-087072 | A | 3/2006 |

OTHER PUBLICATIONS

Translation of JP 08-320679 by http://dossier1.ipdl.inpit.go.jp on Feb. 5, 2010, p. 1-14.

English Language translation of Korean Office Action issued Jul. 1, 2013 for corresponding Korean Application No. 10-2007-0040196.

* cited by examiner

FIG.10

| DETERMINATION ITEM | CRITERIA FOR START EDGE DETERMINATION | CRITERIA FOR END EDGE DETERMINATION | NOTES |
|---|---|---|---|
| GRAYSCALE VALUE | "X" (GRAYSCALE FOR CHARACTER DISPLAYING) | — | WHETHER OR NOT PIXEL HAS GRAYSCALE VALUE USED FOR CHARACTER DISPLAYING IS DETECTED |
| GRAYSCALE DIFFERENCE FROM PREVIOUS PIXEL | "+Y" OR MORE (GRAYSCALE DIFFERENCE FROM BACKGROUND) | "±1" OR MORE (DETECTION OF GRAYSCALE OTHER THAN CHARACTER DISPLAYING GRAYSCALE) | EDGE BETWEEN BACKGROUND PART AND CHARACTER PART IS DETECTED |
| CHARACTER DETERMINATION CONDITION | CONDITION A | CONDITION B | PIXELS FROM PIXEL SATISFYING CONDITION A TO PIXEL PREVIOUS TO PIXEL SATISFYING CONDITION B ARE DETERMINED AS CHARACTER PART |

CHARACTER HIGHLIGHTING CONTROL APPARATUS, DISPLAY APPARATUS, HIGHLIGHTING DISPLAY CONTROL METHOD, AND COMPUTER PROGRAM

CROSS REFERENCES TO RELATED APPLICATIONS

The present invention is a Continuation of application Ser. No. 13/864,772, filed Apr. 17, 2013, now U.S. Pat. No. 8,743,147, issued on Jun. 3, 2014, which is a Continuation of application Ser. No. 13/739,499, filed Jan. 11, 2013, which is a Divisional of Application Ser. No. 11/790,134, filed on Apr. 24, 2007, now U.S. Pat. No. 8,373,726, issued on Feb. 12, 2013, and contains subject matter related to Japanese Patent Application JP 2006-127090 filed in the Japanese Patent Office on Apr. 28, 2006, the entire contents of which being incorporated herein by reference.

BACKGROUND OF THE INVENTION

1. Field of the Invention

The present invention to be described in this specification relates to a technique for enhancing the visibility of a character part. The embodiments of the invention proposed by the present inventors encompass a character highlighting control apparatus, display apparatus, highlighting display control method, and computer program.

2. Description of the Related Art

Japanese Patent Laid-open No. 8-320679 discloses a displaying technique for highlighting a specific display area independently of the other area.

Furthermore, Japanese Patent Laid-open No. 2004-172879 discloses a technique for, in reproduction and displaying of a captured image, highlighting an area specified at the time of the image capturing.

However, in the technique of the former patent document, a plane is specified as the highlighting area. Therefore, even when highlighting of certain character information is desired, an area including also a background part needs to be specified.

In the technique of the latter patent document, a highlighting area is decided at the time of image capturing, and hence optional specification of any highlighting area is difficult.

SUMMARY OF THE INVENTION

According to an embodiment of the present invention, a character highlighting control apparatus includes a character pixel extractor configured to extract a pixel corresponding to a character part from input image data, and a highlighting degree controller configured to carry out control in such a way that the maximum emission luminance of a display device is linked with input image data, to thereby selectively increase the emission luminance of an extracted pixel on a display screen and avoid increase of the emission luminance of a background part on the display screen.

If the scheme proposed by the present inventors is employed, the emission luminance of a character part can be selectively increased compared with that of a background part irrespective of the contents and position of the character part.

BRIEF DESCRIPTION OF THE DRAWINGS

FIG. 10 is a table for explaining conditions of determination of character pixels;

DETAILED DESCRIPTION OF THE PREFERRED EMBODIMENTS

Highlighting techniques relating to the embodiment of the present invention will be described below.

Well-known or publicly-known techniques in the related technical field may be applied to features that are not illustrated or described in the present specification.

It should be noted that the following embodiments are merely one embodiment example of the invention, and the invention is not limited thereto.

(A) First Embodiment

In a first embodiment of the invention, an organic EL panel as one example of a self-luminous display is employed as a display device.

(A-1) System Configuration

Figure 1:
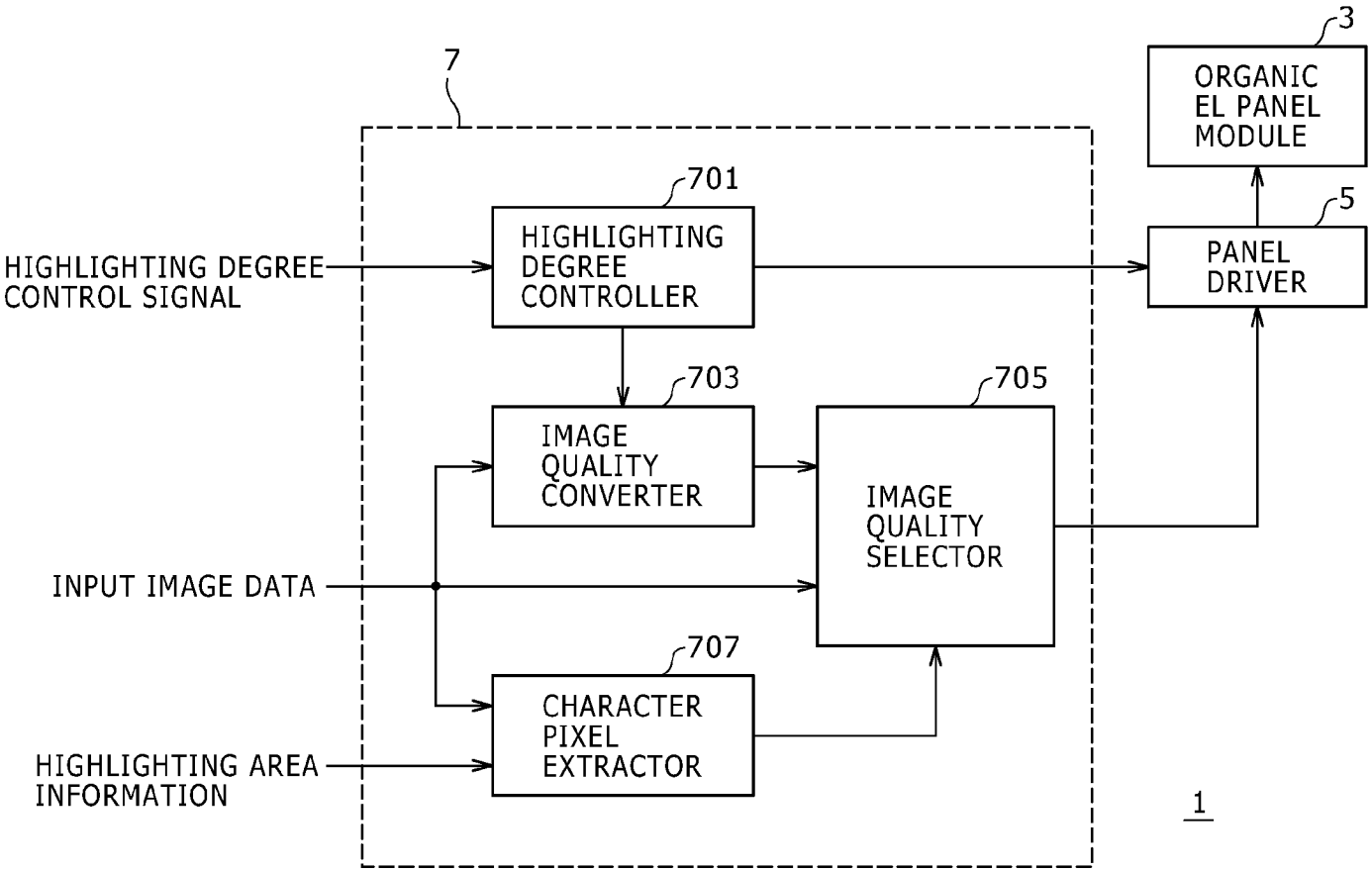
FIG. 1 is a diagram showing a functional configuration example of an organic EL display (first embodiment of the present invention)

FIG. 1 shows a functional configuration example of an organic EL display that has a function to highlight a character part. An organic EL display 1 shown in FIG. 1 includes an organic EL panel module 3, a panel driver 5, and a character highlighting controller 7.

(a) Organic EL Panel Module

The organic EL panel module 3 is a display device in which display pixels of the three basic primary colors (R, G, B) are arranged in a matrix. The respective basic primary colors are generated by organic EL light-emitting elements.

Figure 2:
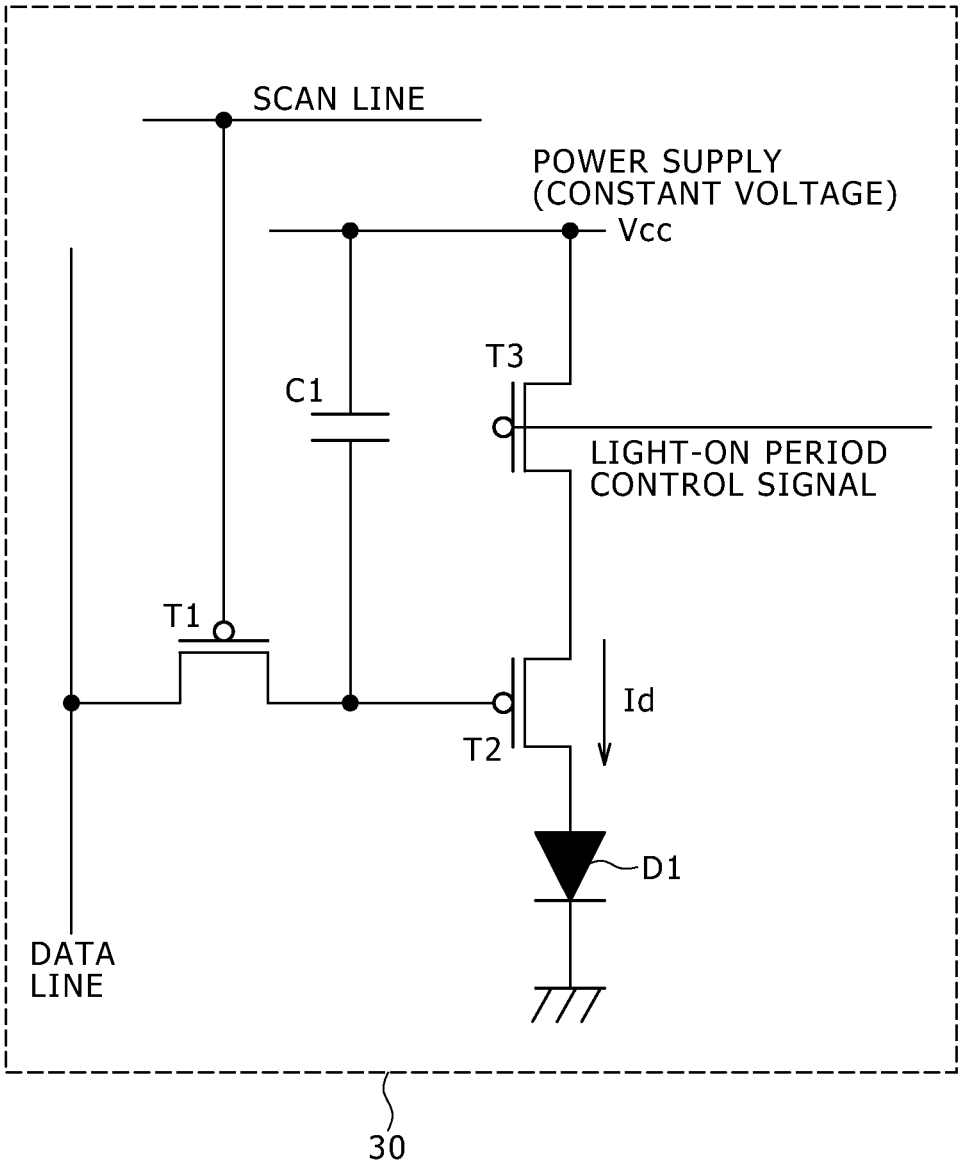
FIG. 2 is a diagram showing an example of a drive circuit of each pixel.

FIG. 2 shows an example of a drive circuit for controlling the emission operation of the organic EL element.

A drive circuit 30 is disposed at the intersection between a data line and a scan line. The drive circuit 30 includes a data switch element T1, a capacitor C1, a current supply element T2, and an emission period control element T3.

The data switch element T1 is a transistor that controls capturing of a voltage value supplied from the data line. The capturing timings are line-sequentially given through the scan lines.

The capacitor C1 is an element that holds the captured voltage value during one frame period. The use of the capacitor C1 realizes field-sequential driving.

The current supply element T2 is a transistor that supplies a drive current dependent upon the voltage value of the capacitor C1 to an organic EL light-emitting element D1.

The emission period control element T3 is a transistor that controls supply and stop of the drive current to the organic EL light-emitting element D1.

The emission period control element T3 is disposed in series to the supply path of the drive current. The organic EL light-emitting element D1 emits light during the period when the emission period control element T3 is ON. In contrast, the organic EL light-emitting element D1 does not emit light during the period when the emission period control element T3 is OFF.

In this example, the switching ON/OFF of the emission period control element T3 is realized by a light-on (emission) period control signal.

The light-on period control signal is produced by the panel driver 5. The production of the light-on period control signal is based on a peak luminance control signal supplied from the character highlighting controller 7.

In this circuit configuration, adjustment of the maximum luminance of the display screen can be realized through adjustment of the emission period of the organic EL light-emitting elements D1.

Figures 3A, 3B, 3C:
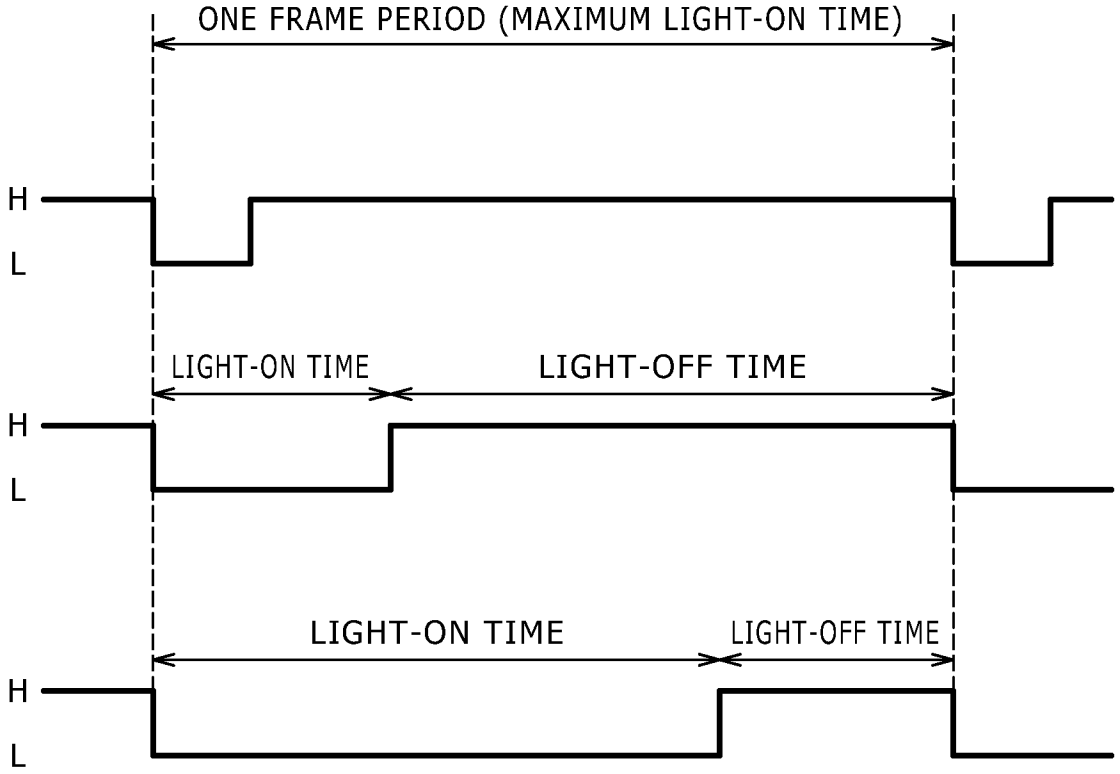
FIGS. 3A, 3B, and 3C are diagrams for explaining operation for varying a light-on period.

FIG. 3 shows one example of the light-on period control signal for controlling the operating state of the emission period control element T3. FIG. 3A shows a vertical synchronous signal as a timing signal. The period between vertical pulses corresponds to one frame period.

FIGS. 3B and 3C show the light-on period control signal. The light-on period control signal controls the ratio of the period during which the organic EL light-emitting element D1 emits light to one frame period. In this embodiment, the "L" level period is equivalent to the light-on time. Therefore, the panel driver 5 varies and controls the "L" level period (emission period) of the light-on period control signal so that the maximum luminance defined by the light-on period control signal can be achieved.

The maximum luminance of the display screen can be adjusted also through increase/decrease of a supply voltage Vcc of the drive circuit or increase/decrease of a supply voltage Vcc of a digital/analog conversion circuit.

Figures 4A, 4B:
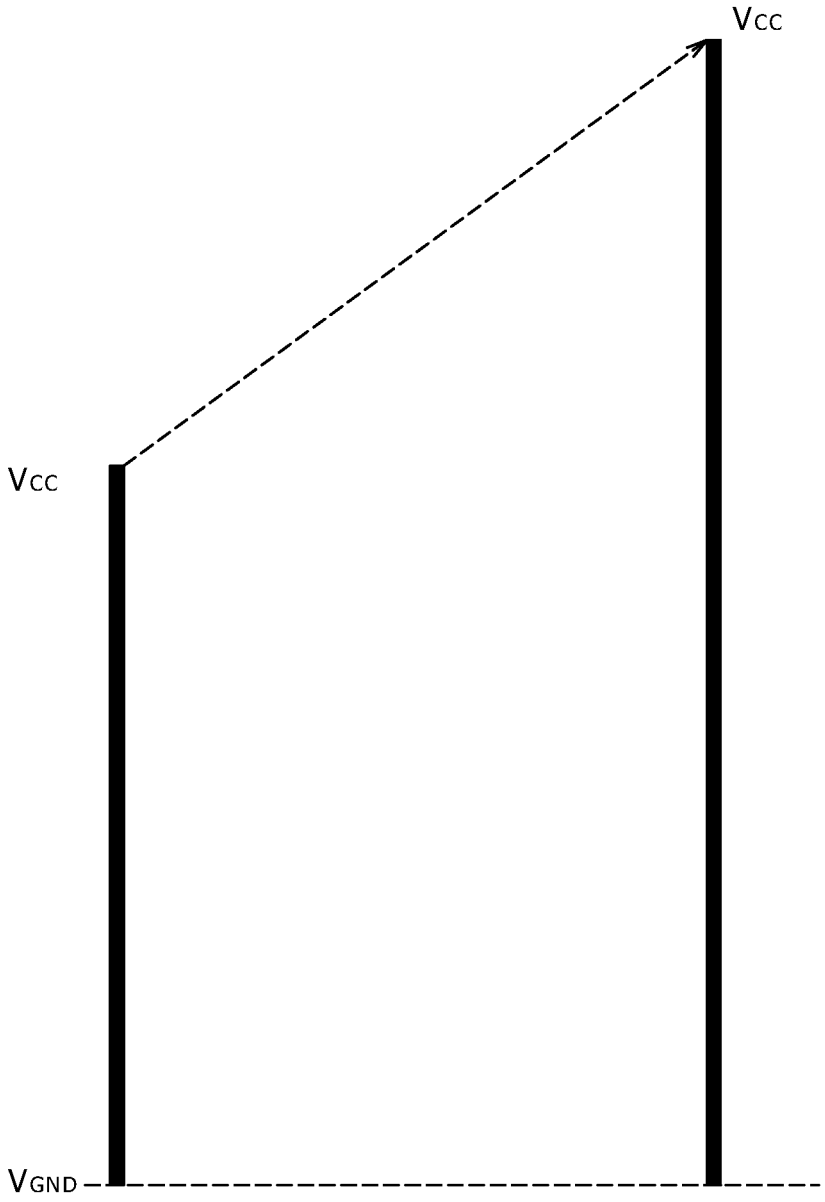
FIGS. 4A and 4B are diagrams for explaining operation for controlling a supply voltage.

FIG. 4 shows an example of supply of the voltage Vcc. FIG. 4A shows the supply voltage Vcc employed before highlighting of a character part (at the time of normal displaying). FIG. 4B shows the supply voltage Vcc employed during highlighting of a character part.

By increasing the supply voltage Vcc as shown in FIG. 4B, the amount of the current that flows through the organic EL light-emitting element D1 can be increased, and the maximum amplitude of an analog voltage applied to the data line can be increased. As a result, the emission luminance on the display screen can be controlled so that it can be higher in response to supply of the same grayscale value.

(b) Panel Driver

The panel driver 5 is a circuit device that generates a drive signal and a drive voltage necessary for driving of the organic EL panel module 3.

The drive signal encompasses not only a horizontal scan pulse, vertical scan pulse, light-on period control signal, and other drive pulses but also an analog voltage generated based on input image data (grayscale value).

In addition, the drive voltage encompasses not only the supply voltages Vcc of the drive circuits corresponding to the respective organic EL light-emitting elements but also the supply voltage Vcc of the digital/analog conversion circuit that generates an analog voltage to be applied to the data line.

The panel driver 5 performs operation of setting, of these drive signals and drive voltages, parameters to be used for control of the maximum luminance based on the peak luminance control signal.

(c) Character Highlighting Controller

The character highlighting controller 7 is a processing device that implements a processing function to realize highlighting. In this highlighting, the light emission luminance is increased for, of the display screen, a character part that exists in a specific area specified in linkage with displayed content of an application program.

The character highlighting controller 7 includes a highlighting degree controller 701, an image quality converter 703, an image quality selector 705, and a character pixel extractor 707.

The highlighting degree controller 701 executes processing for determining the degree of increase in the maximum luminance based on a highlighting degree signal supplied from the external, and processing for determining the degree of gamma conversion by the image quality converter 703.

The highlighting degree signal indicates the degree of highlighting of a character part and is specified in linkage with displayed content of an application program.

The highlighting degree controller 701 controls the driving condition of the panel driver 5 depending on the determined increase degree of the maximum luminance. The driving condition differs depending on the method for adjustment of the maximum luminance.

Specifically, if the maximum luminance is adjusted through increase/decrease in the emission period length, the highlighting degree controller 701 outputs the light-on period control signal to the panel driver 5. If the maximum luminance is adjusted through increase/decrease in the supply voltage Vcc of the drive circuit or increase/decrease in the supply voltage Vcc of the digital/analog conversion circuit, the highlighting degree controller 701 outputs the supply voltage Vcc or a control signal for the voltage Vcc to the panel driver 5.

Figure 5:
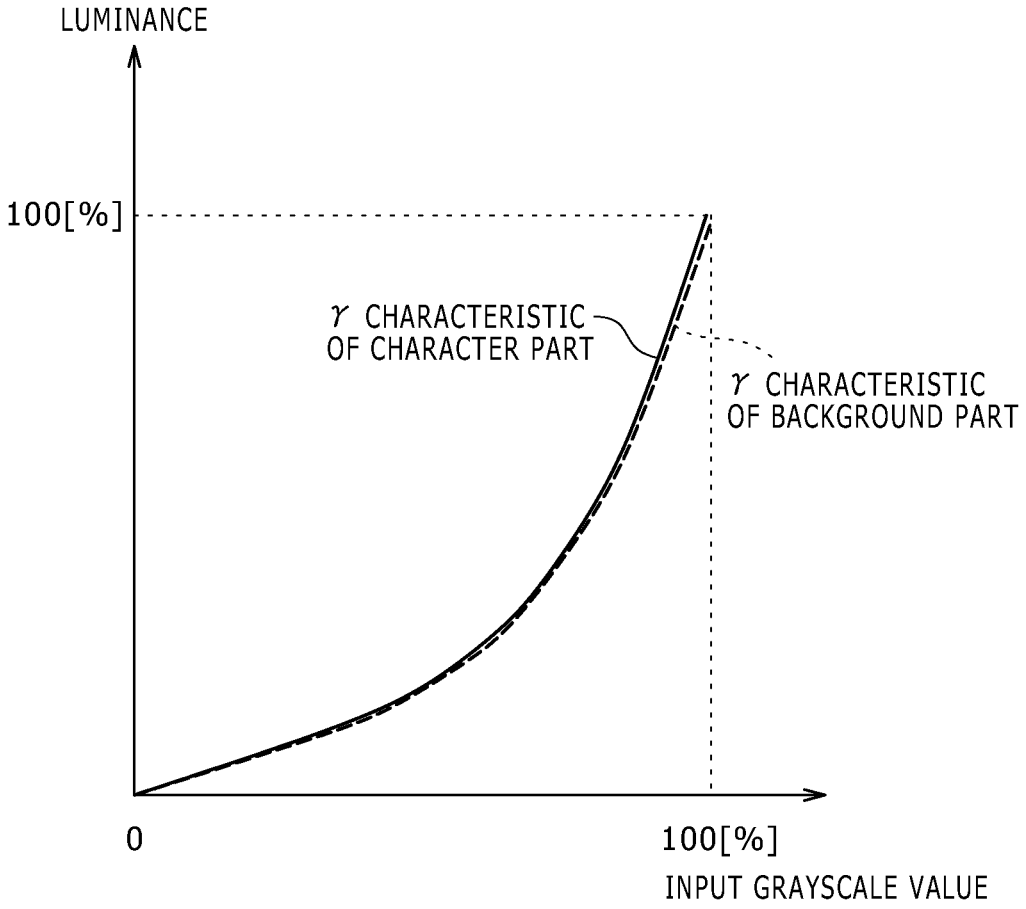
FIG. 5 is a diagram showing the relationship between the gamma characteristics of a character part and a background part employed before increasing of the maximum luminance by a panel driver.
Figure 6:
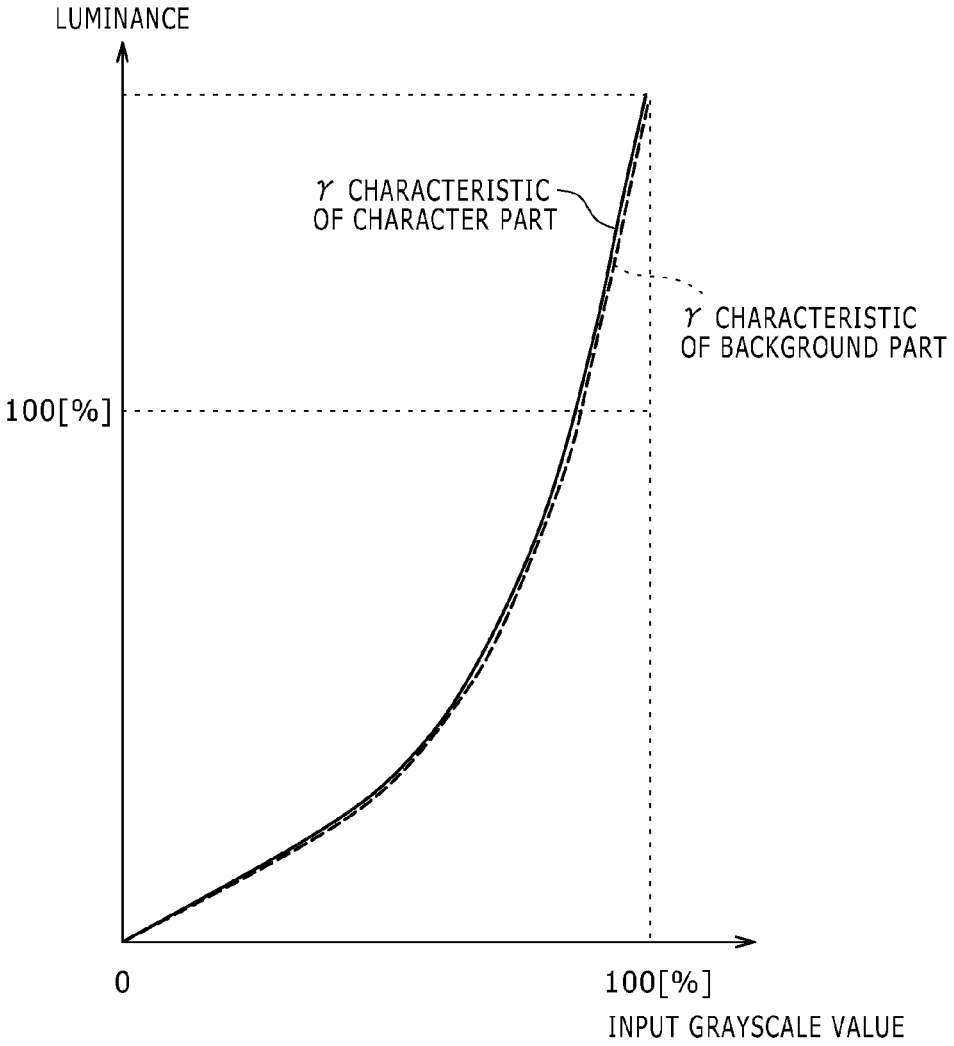
FIG. 6 is a diagram showing the relationship between the gamma characteristics of the character part and the background part obtained after the increasing of the maximum luminance by the panel driver.

However, the increasing of the maximum luminance by the panel driver 5 acts on the entire screen. That is, the maximum luminance of the entire screen is uniformly increased without a distinction between a character part and a background part. FIG. 5 shows the gamma characteristics of a character part and a background part employed before increase in the maximum luminance. FIG. 6 shows the gamma characteristics of the character part and the background part obtained after the increase in the maximum luminance. As shown in FIG. 6, merely increasing the entire maximum luminance does not lead to enhancement in the contrast between the character part and the background part.

Figure 7:
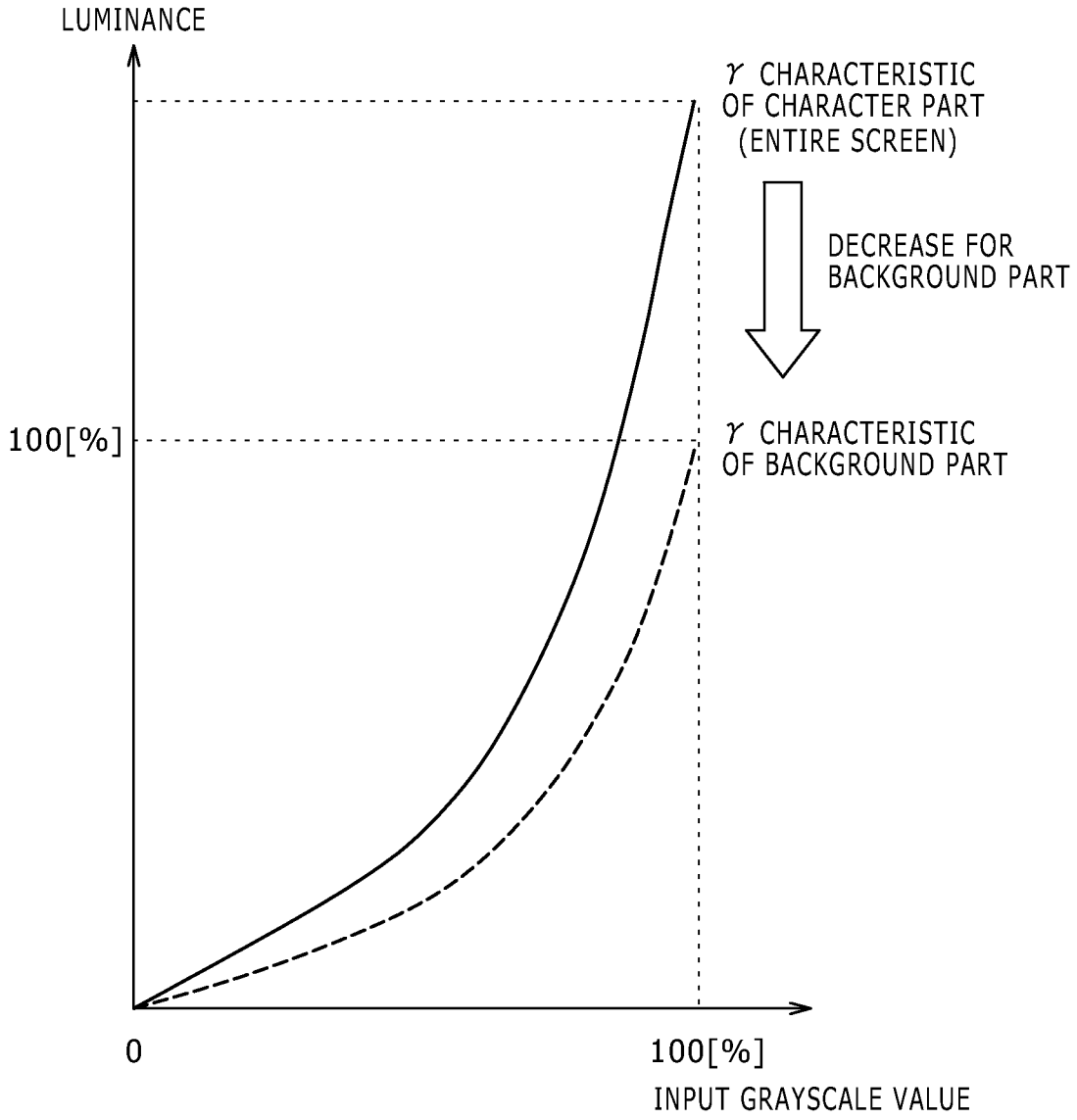
FIG. 7 is a diagram showing the relationship between the gamma characteristics of the character part and the background part obtained when image quality conversion is combined with the increasing of the maximum luminance by the panel driver (first embodiment)

To address this, the highlighting degree controller 701 outputs a control signal for a gamma conversion characteristic to the image quality converter 703 so that the maximum luminance of the background part may be the same as that employed before highlighting of the character part (may not change). Specifically, the highlighting degree controller 701 outputs the gamma conversion characteristic control signal for canceling, for the background part, the effect of the maximum luminance increase by the panel driver 5 as shown in FIG. 7.

In this manner, the gamma conversion characteristic control signal serves to decrease the maximum luminance of input image data by the amount of the maximum luminance increase due to the highlighting degree control signal.

As described above, the amount of the maximum luminance decrease is determined in linkage with the amount of the maximum luminance increase.

The image quality converter 703 is a processing device that uniformly decreases the grayscale values of input image data based on the gamma conversion characteristic control signal. The target of the grayscale conversion is input image data corresponding to all pixels.

Figure 8:
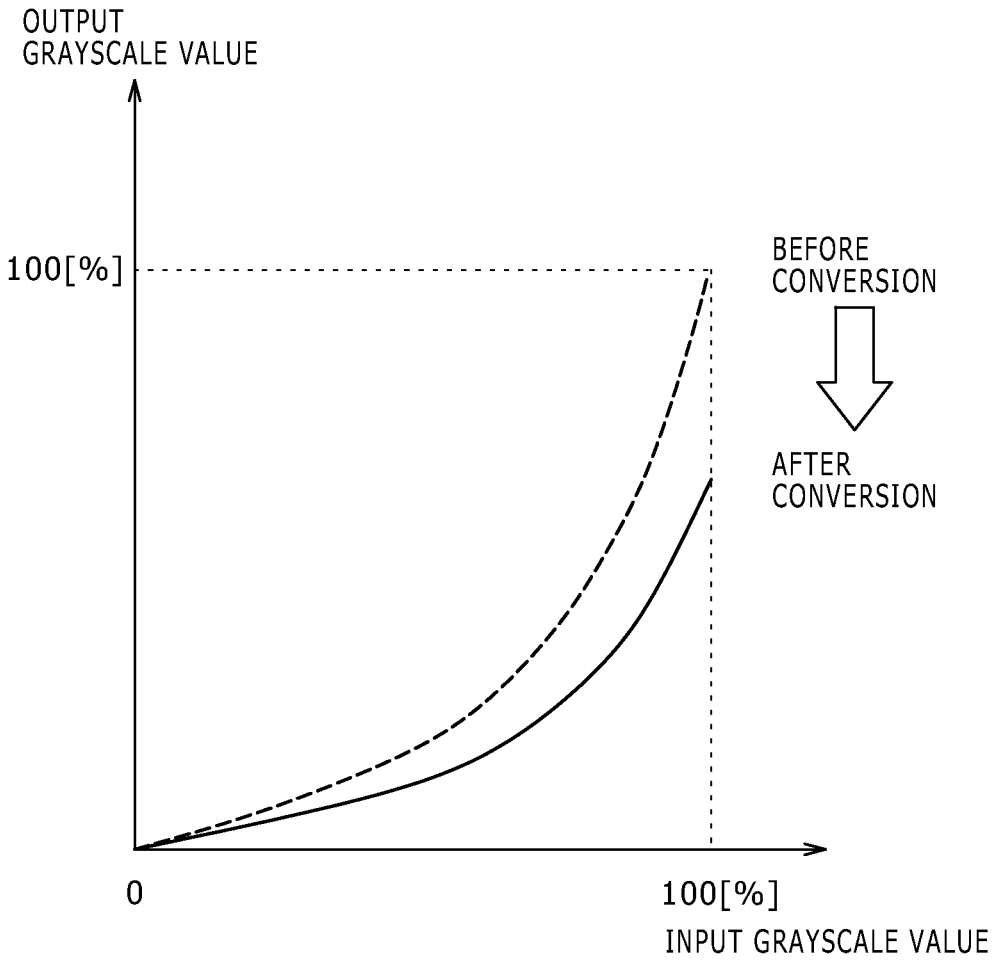
FIG. 8 is a diagram for explaining a gamma conversion characteristic employed by an image quality converter.

FIG. 8 shows execution of the gamma conversion operation. In FIG. 8, the gamma characteristic before gamma conversion is indicated by the dashed line, while that after the gamma conversion is indicated by the full line.

As shown in FIG. 8, the image quality converter 703 totally lowers the luminance levels, which are associated with grayscale values, in such a way that the maximum luminance is decreased while the characteristic of the gamma curve is kept the same (without change of the gamma values).

The image quality selector 705 is a processing device that selectively outputs either one of original input image data and input image data resulting from gamma conversion (referred to also as "before-gamma-conversion input image data" and "after-gamma-conversion input image data", respectively, hereinafter).

The selection of image data is executed on a pixel basis under control by the character pixel extractor 707. The image quality selector 705 selects before-gamma-conversion input image data for a pixel position corresponding to a character part and selects after-gamma-conversion input image data for a pixel position corresponding to a background part.

The character pixel extractor 707 is a processing device that executes processing for extracting pixels each corresponding to a character (referred to as "character pixel", hereinafter) as the target of highlighting from input image data and processing for controlling the selection operation of the image quality selector 705 based on the extraction result.

An area specified by highlighting area information is searched for the character pixels as the highlighting target. The highlighting area information is specified in linkage with displayed content by an application program that supplies input image data. The highlighting area may be the entire screen, or alternatively may be independent one or plural partial areas.

Figure 9:
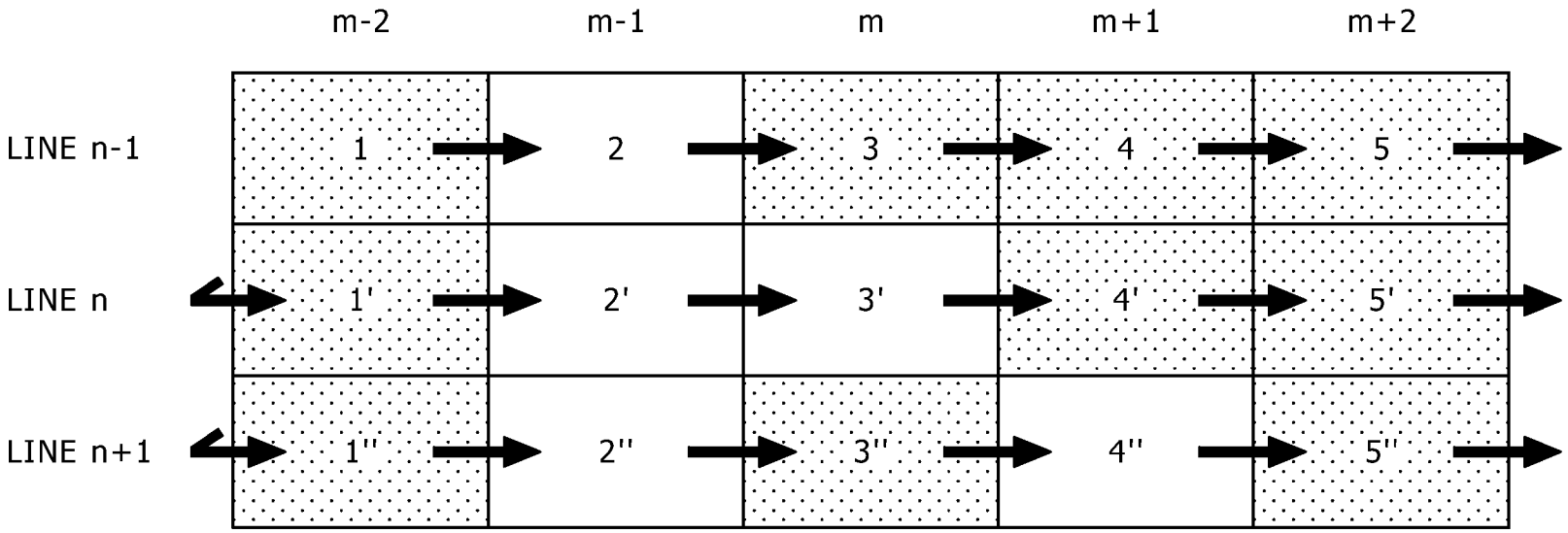
FIG. 9 is a diagram for explaining the principle of extraction of character pixels.

As described above, the character pixel extractor 707 extracts on a pixel basis a character part that exists in a highlighting area. FIG. 9 is an enlarged view showing a screen area including character pixels. Each rectangular region corresponds to a single pixel. In FIG. 9, character pixels are indicated by white blocks, while pixels as a background part are indicated by hatched blocks.

The character pixel extractor 707 makes a determination on a pixel basis as to whether or not the determination-target pixel is a character pixel. As shown by the arrowheads in FIG. 9, the determination processing is executed from the upper-left of the screen in the same order as the transmission order of the input image data.

Initially, the character pixel extractor 707 determines whether or not a determination-target pixel is included in the highlighting area.

If the determination-target pixel exists outside the highlighting area, the character pixel extractor 707 unconditionally determines that the determination-target pixel is a background part.

In contrast, if the determination-target pixel exists in the highlighting area, the character pixel extractor 707 determines whether or not the determination-target pixel is a character pixel based on the following two determination criteria: "the grayscale value of the determination-target pixel" and "the difference in the grayscale between the determination-target pixel and the previous pixel in the transmission order".

The reason why these two items are employed as the determination criteria is that, in general, the situation in which a character part is highlighted will be caused at the time of displaying of an intentionally-prepared screen, such as a menu screen made by an application (program or apparatus).

Another reason is that the displayed content of a background part and a character part will be designed comparatively flexibly.

Further another reason is that a character part is displayed with a luminance higher than that for a background part and the character part is displayed with the same grayscale value in general.

It would be possible that designed colors and so on are also different in an actual display screen. However, the possibility that these conditions are substantially satisfied in a screen in which a character part is highlighted will be high. Therefore, the present inventors employ "grayscale value" and "grayscale difference with respect to the previous pixel in the transmission order" as the determination criteria.

Of these two determination criteria, the "grayscale value" is used in order to determine whether or not the grayscale value of a determination-target pixel matches the grayscale value used for character displaying. In this embodiment, the grayscale value as a determination condition is defined as "X". It is desirable to determine the grayscale value X by taking into consideration not only the expected grayscale value of a character pixel but also the existence of noise.

For example, if a character part is displayed as white (100% luminance) and the grayscale value is represented by eight bits, the grayscale value X is set to "250" also in consideration of "five" grayscales for noise.

If there is a possibility that plural grayscale values are used for character displaying, plural grayscale values X may be prepared.

Furthermore, it is also possible to use separate grayscale values X depending on the color and so on. In this case, a group of grayscale values is prepared for each of the colors (RGB).

The other determination criterion "grayscale difference with respect to the previous pixel in the determination order" is used in order to detect an edge between a background part and a character part. The number of kinds of edge is two: a start edge and an end edge. In this embodiment, the condition relating to the grayscale difference used for detection of a start edge is defined as "+Y or more". Furthermore, the condition relating to the grayscale difference used for detection of an end edge is defined as "±1 or more".

In general, a luminance difference more than a certain value will exist at the boundary between a background part and a character part. The following forms are typically used for character displaying for example: a form in which a character is displayed on a display area having a flat grayscale (background); and a form in which a transparent background is superimposed on any display screen and a character is displayed on the transparent background. In any form, at the time of displaying of a menu screen, a luminance difference more than a certain value will exist between a character part and a surrounding background part.

As the determination condition for the luminance difference, the grayscale difference Y for the determination is defined based on the start-edge grayscale difference that has been known in advance based on an application (program or apparatus).

The grayscale difference Y serves as a criterion of extraction of a pixel corresponding to shift from a dark background part to a luminous character part. Therefore, the grayscale difference Y is represented as a grayscale value having a sign. Specifically, it is represented as "+Y". For example, when the average grayscale value of an image is about 30%, a pixel of which grayscale difference from the previous pixel is 70% (from 30% to 100%) is determined as a start edge.

At this time, the grayscale difference Y is equivalent to a grayscale difference of "+178" or more when a grayscale value is represented by eight bits. However, an actual average grayscale value involves some degree of variation. Therefore, some margin is also taken into consideration actually. Specifically, in the above-described example, the grayscale difference Y for determination of a start edge is set to "+150". In FIG. 10, the condition where these two determination conditions are simultaneously satisfied is defined as condition A.

The character pixel extractor 707 extracts pixels that satisfy condition A as pixels offering a start edge (in FIG. 9 for example, the pixels 2, 2', 2", and 4" at the positions (line n−1, column m−1), (line n, column m−1), (line n+1, column m−1), and (line n+1, column m+1), respectively).

After the determination of the pixels offering a start edge, the character pixel extractor 707 starts processing for determining pixels offering an end edge. The determination of the pixels offering an end edge is carried out depending on whether or not the grayscale difference with respect to the previous pixel is smaller than "±Z". The grayscale difference "±Z" is set to e.g. "±1" when a grayscale value is represented by eight bits. The character pixel extractor 707 determines pixels from a start-edge pixel to a pixel previous to a pixel that satisfies the end-edge condition as character pixels.

The reason why the grayscale difference condition for end edge detection is set smaller than "±Z" is that the grayscale values of character pixels will be constant in general. That is, the reason is that the occurrence of a grayscale difference with respect to the previous pixel will allow a determination that a character part has finished at the previous pixel. In FIG. 10, the condition where this determination condition is satisfied is defined as condition B.

The character pixel extractor 707 extracts pixels that satisfy condition B as pixels offering an end edge (in FIG. 9 for example, the pixels 3, 4', 3", and 5" at the positions (line n−1, column m), (line n, column m+1), (line n+1, column m), and (line n+1, column m+2), respectively). The pixels until the pixel previous to the pixel offering an end edge correspond to a character part, and the pixel determined as the end edge is processed as a background part.

By using these "condition A" and "condition B", the character pixel extractor 707 surely extracts a background part and a character part.

The determination is based on the premise that the above-described various set values such as "X", "+Y", and "±Z" are changed depending on a program or apparatus.

A scheme in which a pixel previous to a pixel corresponding to start of character displaying is necessarily displayed as black is also effective for further enhancement of accuracy of character part extraction.

Figure 11:
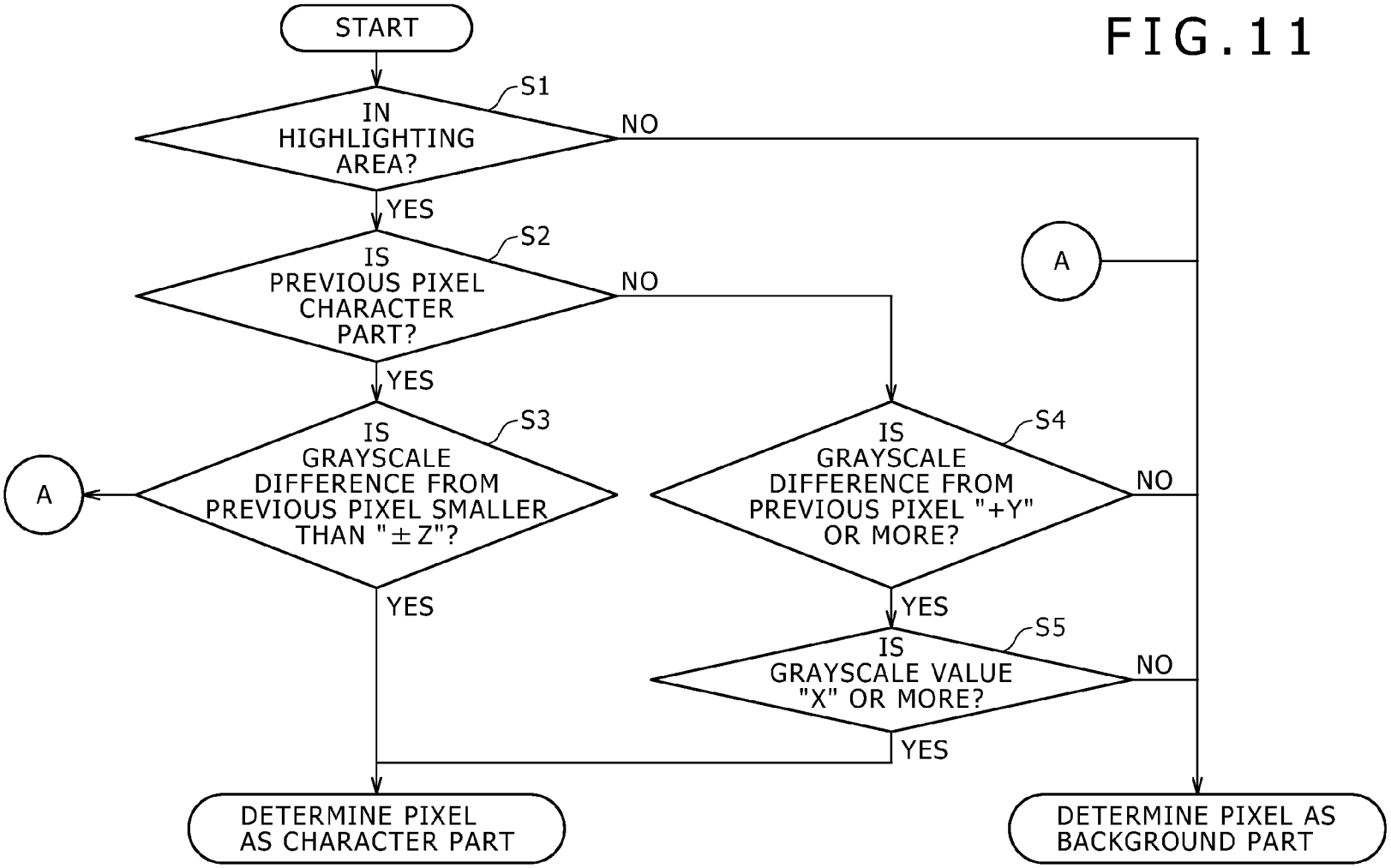
FIG. 11 is a flowchart for explaining the procedure of processing for determining character pixels.

FIG. 11 is a flowchart showing the procedure of the determination processing by the character pixel extractor 707.

Initially, the character pixel extractor 707 determines whether or not a determination-target pixel is included in a highlighting area (S1).

If "No" is obtained in the determination processing S1, the character pixel extractor 707 unconditionally determines that the determination-target pixel is a background part.

If "Yes" is obtained in the determination processing S1, the character pixel extractor 707 determines whether or not the previous pixel is a character part (S2).

If the previous pixel is a character part (if "Yes" is obtained in the step S2), the character pixel extractor 707 determines whether or not the grayscale difference with respect to the previous pixel is smaller than "±Z" (S3). The character pixel extractor 707 determines that the determination-target pixel is a "character part" if "Yes" is obtained in the determination processing S3, and determines that it is a "background part" if "No" is obtained in the step S3.

If the previous pixel is not a character part (if "No" is obtained in the step S2), the character pixel extractor 707 determines whether or not the grayscale difference with respect to the previous pixel is "+Y" or more (S4). If "No" is obtained in the determination processing S4, the character pixel extractor 707 determines that the determination-target pixel is a "background part". In contrast, if "Yes" is obtained in the determination processing S4, the character pixel extractor 707 determines whether or not the grayscale value of the determination-target pixel is "X" or more (S5).

The character pixel extractor 707 determines that the determination-target pixel is a "character part" if "Yes" is obtained in the determination processing S5, and determines that it is a "background part" if "No" is obtained in the step S5.

(A-2) Highlighting Examples

Images of highlighting of a character part will be shown below with use of FIGS. 12 to 14.

Figure 12:
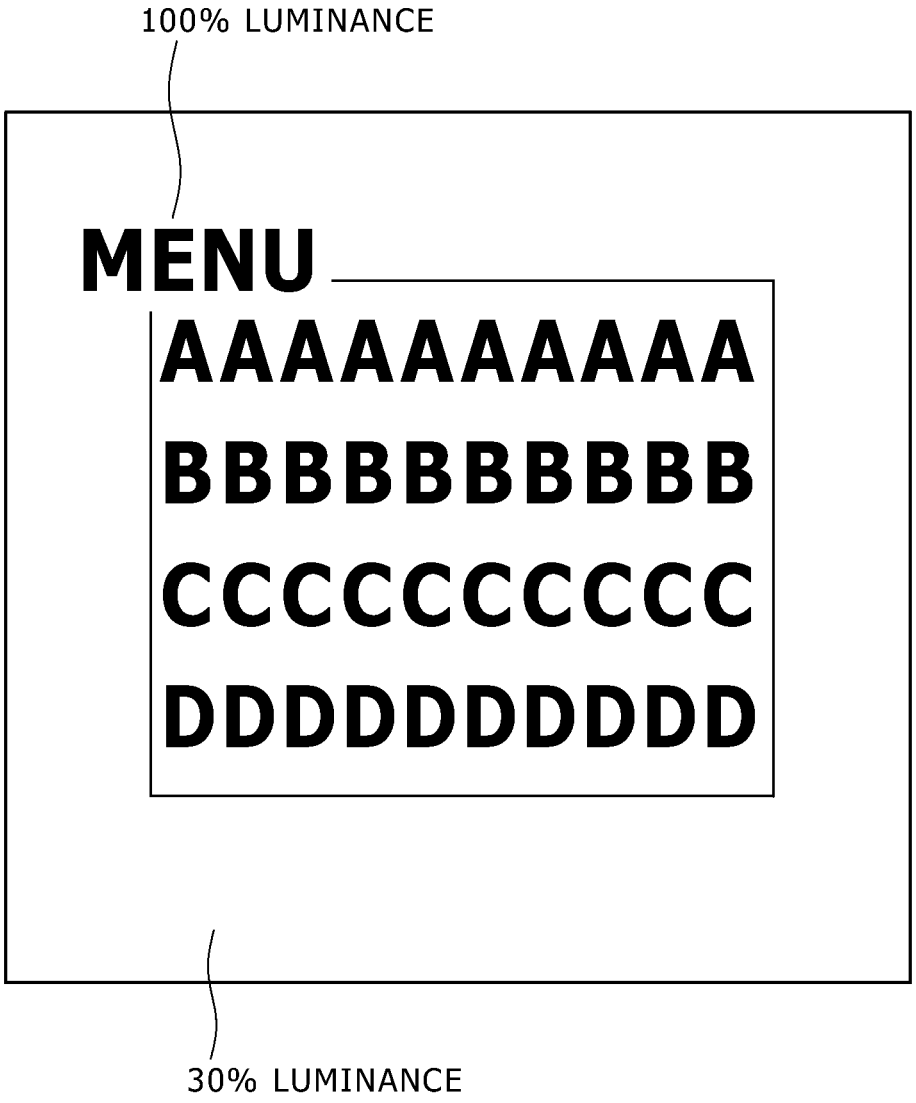
FIG. 12 is a diagram showing a screen example displayed before character highlighting.

FIG. 12 shows an example of a display screen obtained before execution of highlighting. That is, this screen displays an original image. A menu screen is displayed on the entire screen. In this example, the background part has a 30% luminance while the character part has a 100% luminance.

Figure 13:
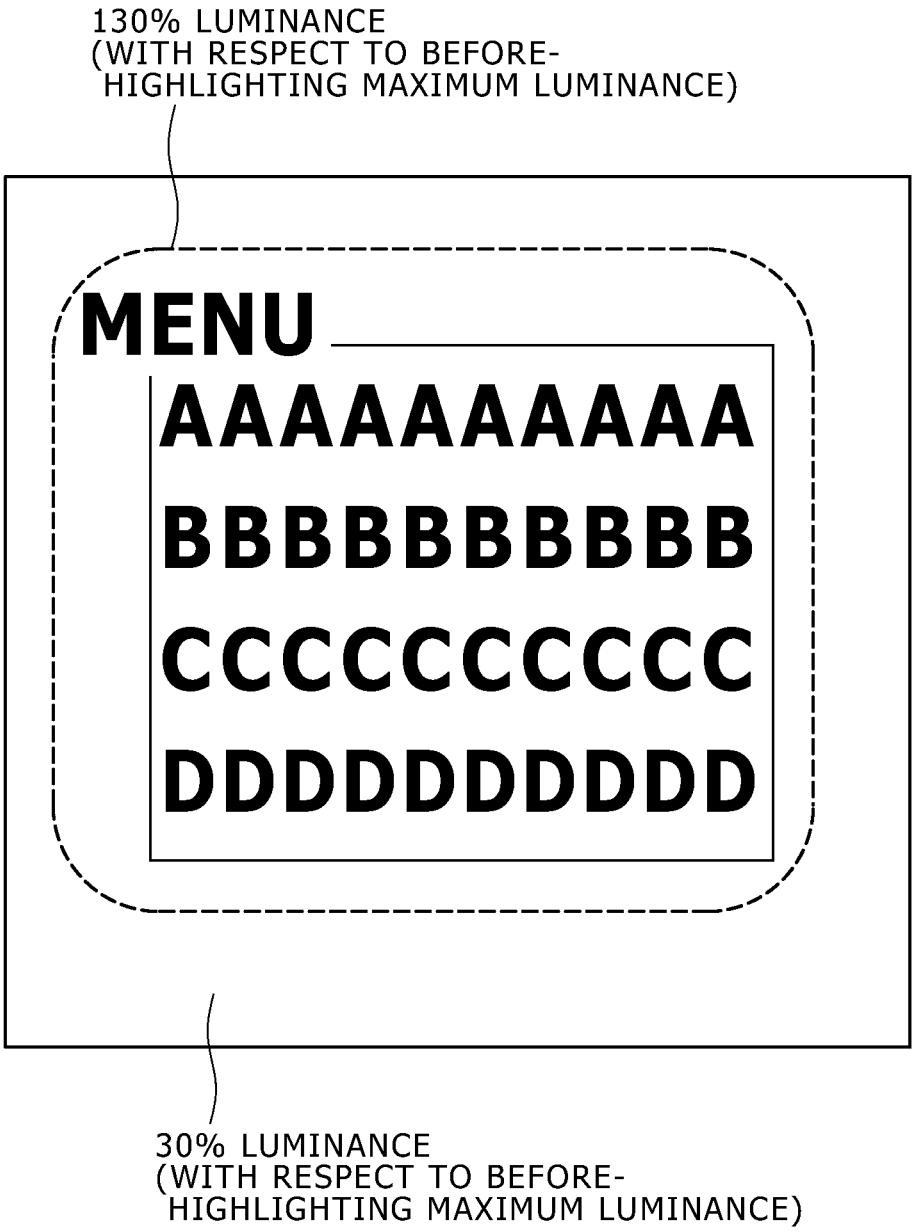
FIG. 13 is a diagram showing an example of highlighting of a character part when an entire screen is defined as a highlighting area (first embodiment)

FIG. 13 shows an example of a display screen when highlighting of a character part is carried out with the entire screen defined as a highlighting area.

The luminance of the character part (surrounded by the dashed line) is increased by 30% with respect to the before-highlighting maximum luminance. That is, the maximum luminance is increased to a 130% luminance. In contrast, the luminance of the background part is kept the same as the before-highlighting luminance. As a result, the contrast between the character part and the background part is enhanced, which allows a user to recognize the character part more surely.

Figure 14:
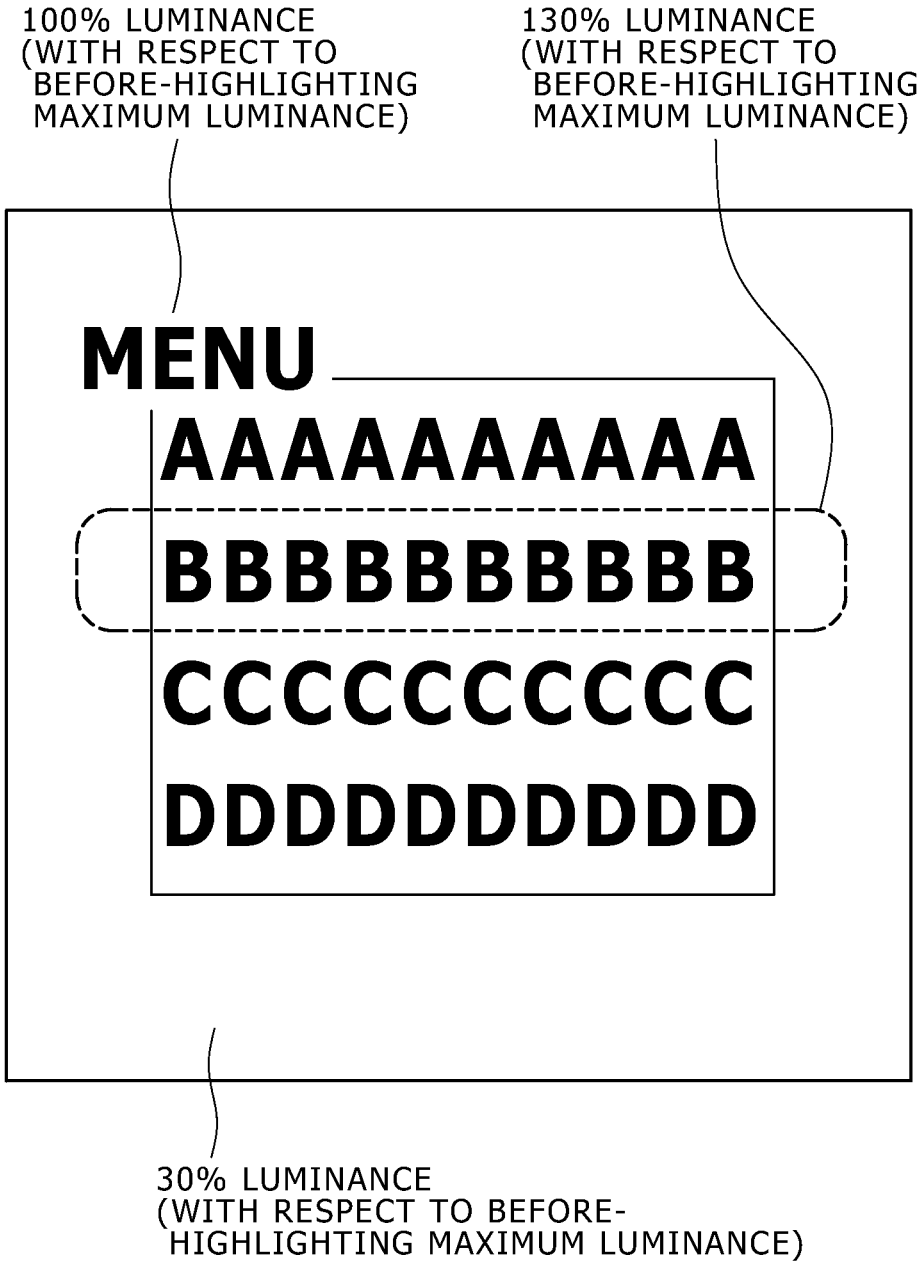
FIG. 14 is a diagram showing an example of highlighting of a character part when a part of a screen is defined as a highlighting area (first embodiment)

FIG. 14 shows an example of a display screen when highlighting of a character part is carried out with a partial area surrounded by the dashed line defined as a highlighting area.

In this example, the luminance of the character part surrounded by the dashed line is increased by 30% with respect to the before-highlighting maximum luminance, while the luminance of the other character part is kept the same as the before-highlighting luminance. In this case, the character part other than that on the one row specified as the highlighting area is treated as the background part.

As a result, the selected character part is highlighted so as to be displayed in a more noticeable form compared with the other character part.

The image area determined as the background part is so subjected to gamma conversion at the time of data processing that the grayscale range thereof is compressed. However, the grayscale range is returned to that of the original image through the effect of the maximum luminance increase executed by the panel driver 5. Therefore, the image quality of the background part is not deteriorated.

(A-3) Advantageous Effects

As described above, using this displaying function allows selective increase of the emission luminance of pixels corresponding to a character part in a specified highlighting area.

This enhances usability for a user because the visibility of character information tends to increase as the contrast between the character information and the surrounding area becomes higher. When there is a need to view a screen under an outdoor or bright surrounding environment in particular, the feature that a character part is clearly displayed is advantageous not only in enhancement of usability but also in enlargement of the use range.

The increase in the maximum luminance inevitably leads to increase in the power consumption. However, in this embodiment, pixels of which maximum luminance is increased can be limited to pixels serving as a character part. Therefore, the increase in the power consumption can be suppressed to the necessary minimum.

Hence, when this function is incorporated in an electronic apparatus driven by a battery, displayed information can be viewed easily without significant shortening of its driving time.

In addition, the circuit scale and arithmetic operation amount necessary for realization of this displaying technique may be small. This allows the character highlighting controller 7 to be incorporated as a part of an integrated circuit such as a timing generator. Such a configuration is advantageous in terms of the manufacturing thereof because the provision of the character highlighting controller 7 has no effect on existing peripheral circuits.

(B) Second Embodiment

A description will be made below about an improved configuration that allows further enhancement of the visibility of a character part and reduction in power consumption.

The visibility of a character part is basically in proportion to the contrast between the character part and a surrounding background part. Furthermore, in the case of a display device in which self-luminous display elements are arranged, the power consumption is in proportion to the brightness of the screen.

Therefore, in a second embodiment of the present invention, the after-highlighting screen luminance of a background part is aggressively decreased so as to be lower than the before-highlighting screen luminance of the background part, to thereby simultaneously realize contrast enhancement and power consumption decrease.

(B-1) System Configuration

Figure 15:
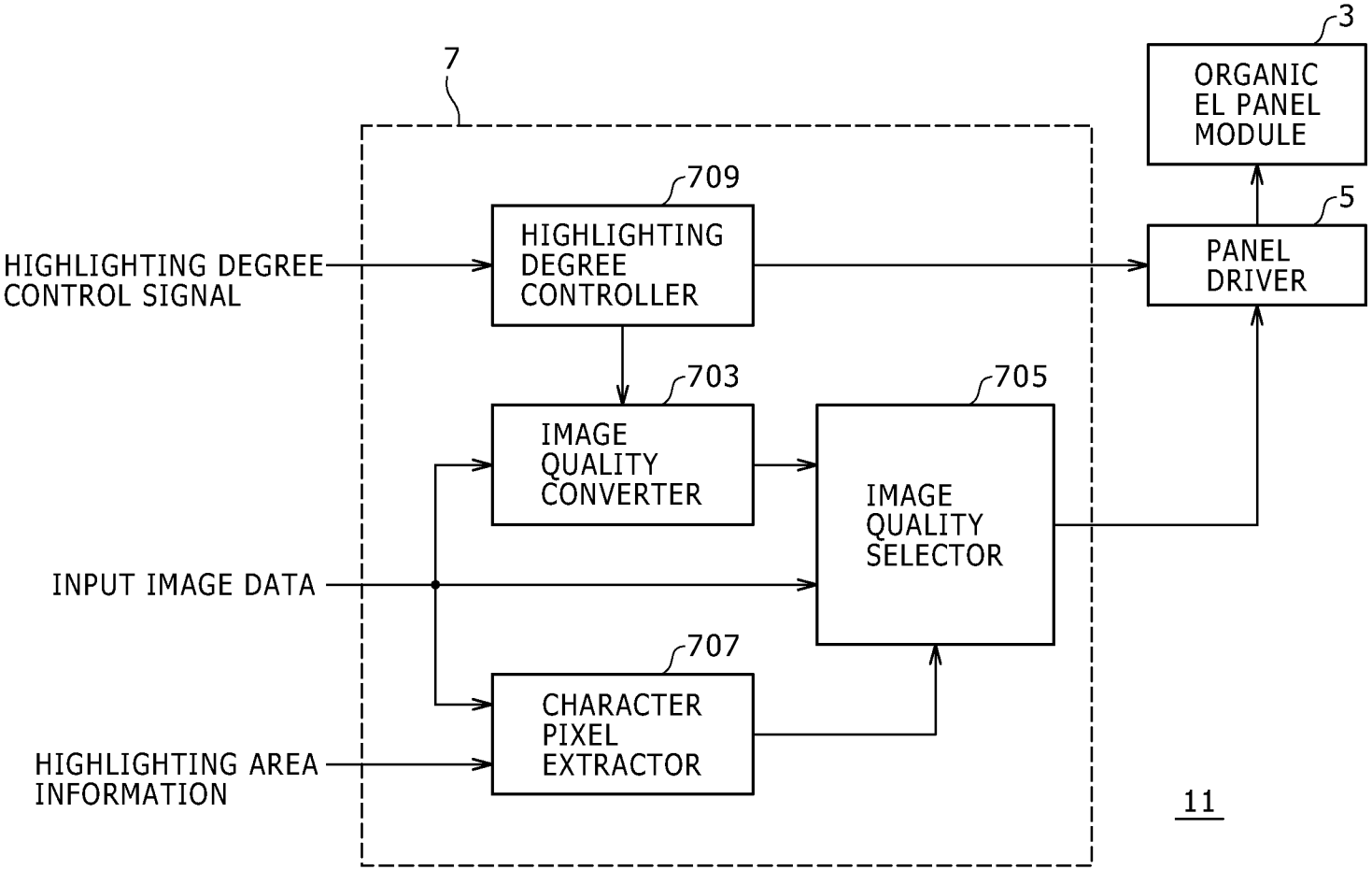
FIG. 15 is a diagram showing a functional configuration example of an organic EL display (second embodiment of the invention)

FIG. 15 shows a functional configuration example of an organic EL display to which this kind of function is added. The same components in FIG. 15 as those in FIG. 1 are given the same numerals.

As shown in FIG. 15, the basic block configuration of an organic EL display 11 is the same as that of the organic EL display 1 shown in FIG. 1.

The difference therebetween is a way of determining a gamma conversion characteristic control signal supplied from a highlighting degree controller 709 to the image quality converter 703.

In the first embodiment, the amount of the maximum luminance decrease is so defined that the maximum luminance of input image data is decreased by the same amount as the amount of the maximum luminance increase based on a highlighting degree control signal. On the other hand, in the second embodiment, a larger decrease amount is indicated.

Figure 16:
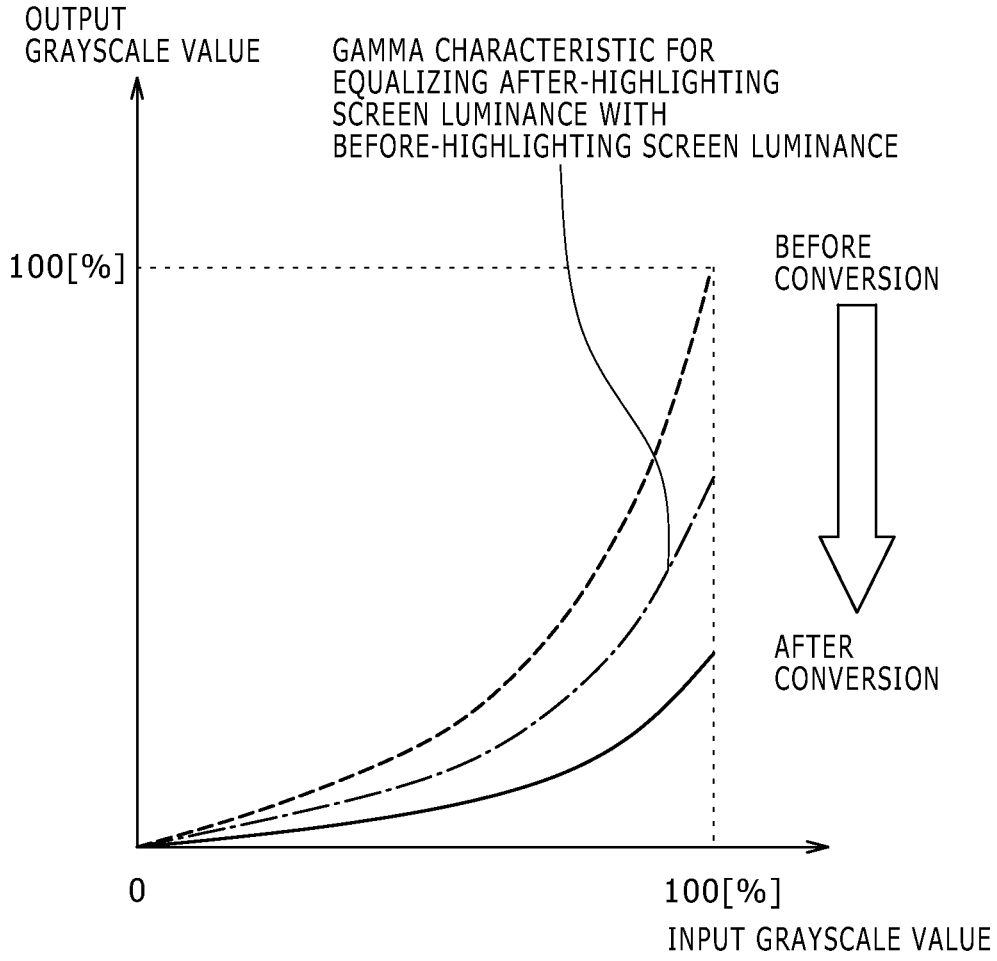
FIG. 16 is a diagram for explaining a gamma conversion characteristic employed by an image quality converter.

FIG. 16 shows an example of gamma conversion operation executed by the image quality converter 703. In FIG. 16, the gamma characteristic before gamma conversion is indicated by the dashed line, while that after the gamma conversion is indicated by the full line. In addition, the after-conversion gamma characteristic in the first embodiment is indicated by the dashed-dotted line.

As shown in FIG. 16, the highlighting degree controller 709 in this embodiment sets the amount of the decrease in the luminance level through gamma conversion larger than highlighting degree.

Figure 17:
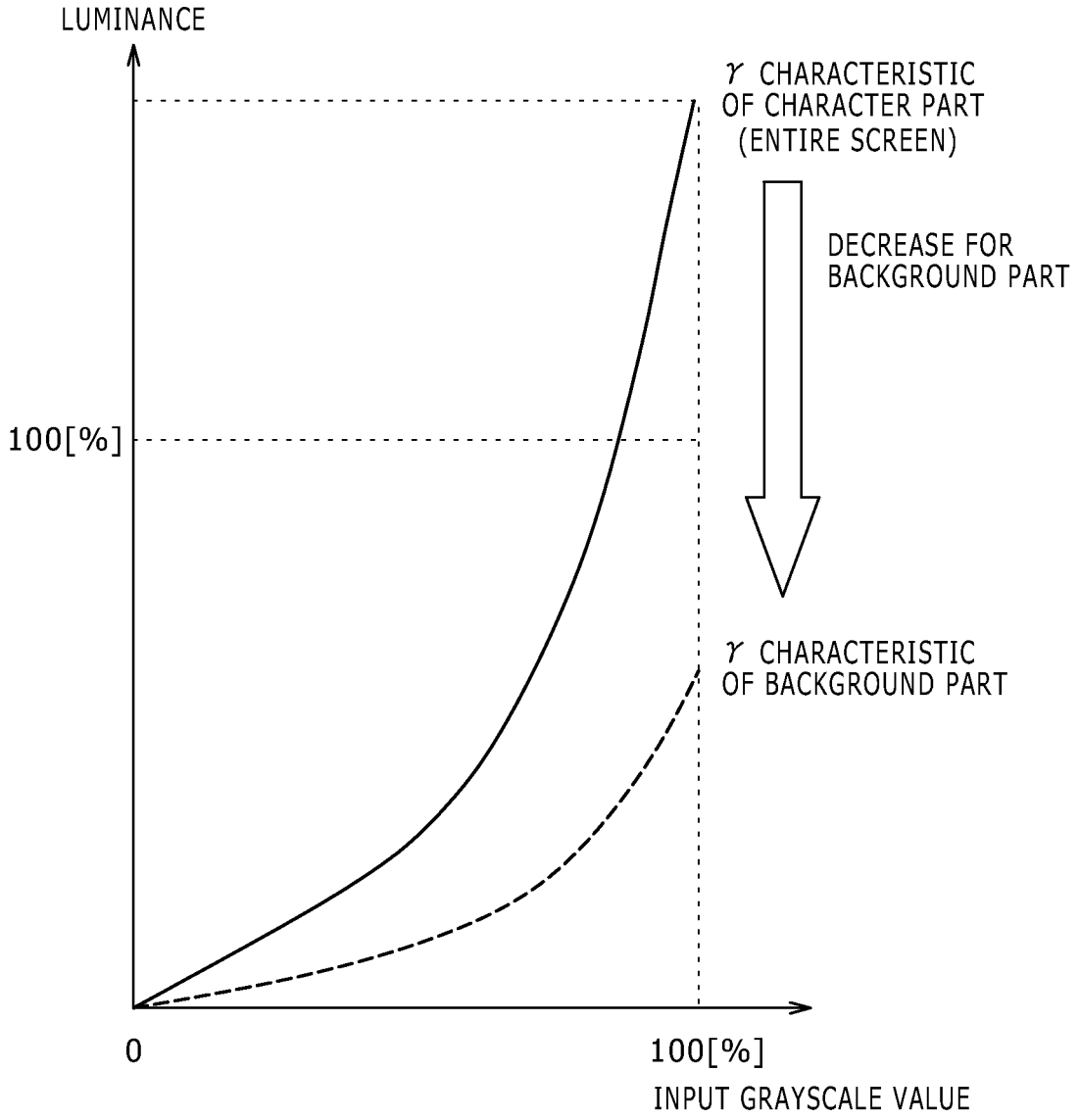
FIG. 17 is a diagram showing the relationship between the gamma characteristics of a character part and a background part obtained when image quality conversion is combined with increasing of the maximum luminance by a panel driver (second embodiment)

As a result, the emission luminance characteristics of the respective parts viewed on the display screen become those shown in FIG. 17. In FIG. 17, the gamma characteristic of a character part is indicated by the full line, while that of a background part is indicated by the dashed line.

As is apparent from FIG. 17, in this embodiment, the maximum luminance of the background part is decreased to a value lower than 100% with respect to the before-highlighting maximum luminance. Therefore, the contrast between the background part and the character part is enhanced.

(B-2) Highlighting Examples

Images of highlighting of a character part will be shown below with use of FIGS. 18 to 20.

Figure 18:
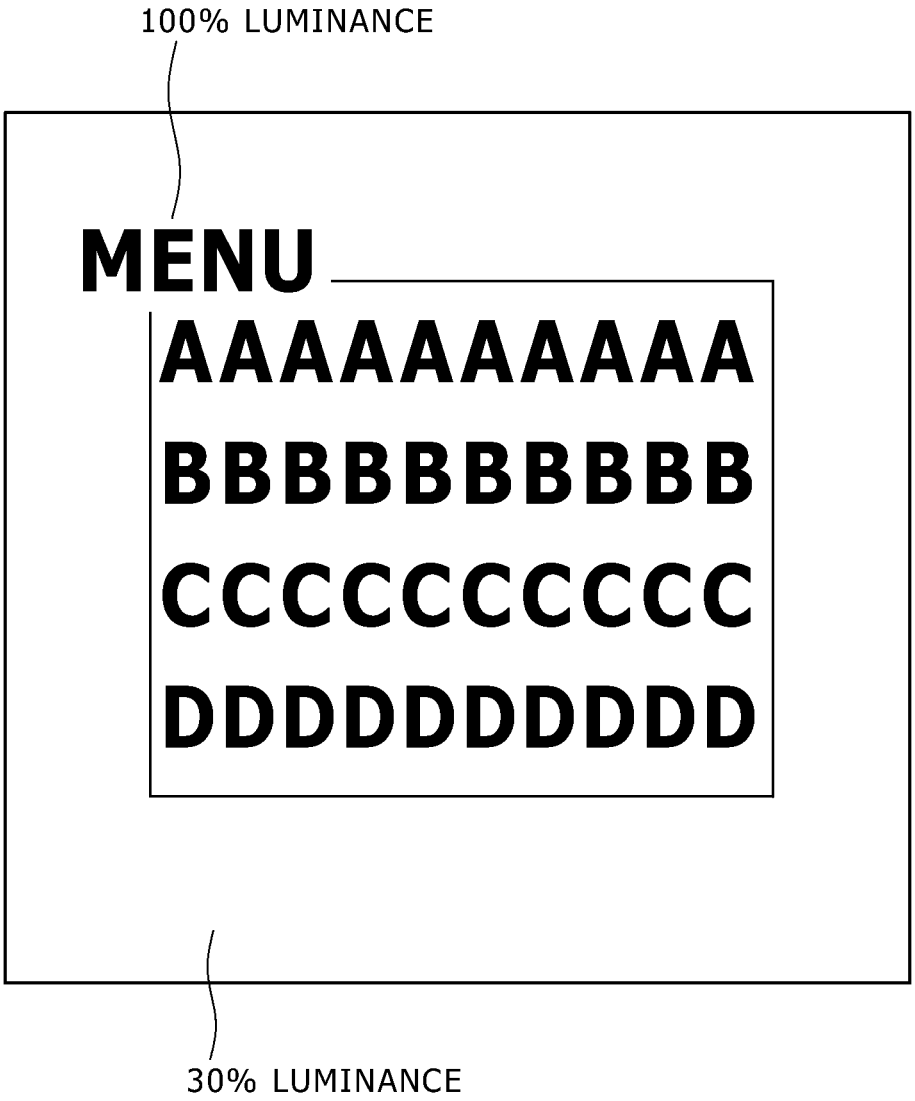
FIG. 18 is a diagram showing a screen example displayed before character highlighting.

FIG. 18 shows an example of a display screen obtained before execution of highlighting. That is, this screen displays an original image. A menu screen is displayed on the entire screen. Basically, the background part has a 30% luminance, while the character part has a 100% luminance.

Figure 19:
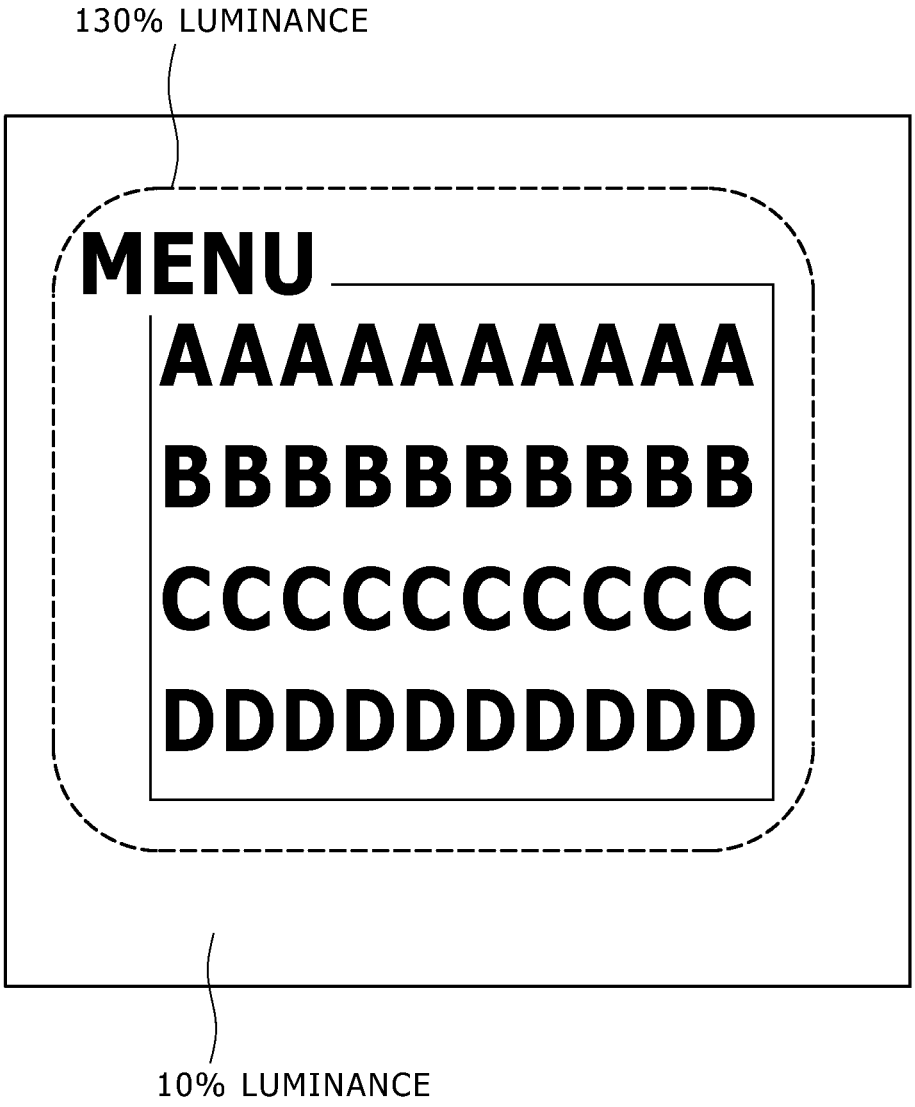
FIG. 19 is a diagram showing an example of highlighting of a character part when an entire screen is defined as a highlighting area (second embodiment)

FIG. 19 shows an example of a display screen when highlighting of a character part is carried out with the entire screen defined as a highlighting area.

The luminance of the character part (surrounded by the dashed line) is increased by 30% with respect to the before-highlighting maximum luminance. In contrast, the luminance of the background part is decreased to about 10% with respect to the before-highlighting maximum luminance, i.e., to about one-third of the before-highlighting luminance. As a result, the luminance difference between the character part and the background part is increased by 20% compared with in the first embodiment, and hence a user is allowed to recognize the character part more surely.

Figure 20:
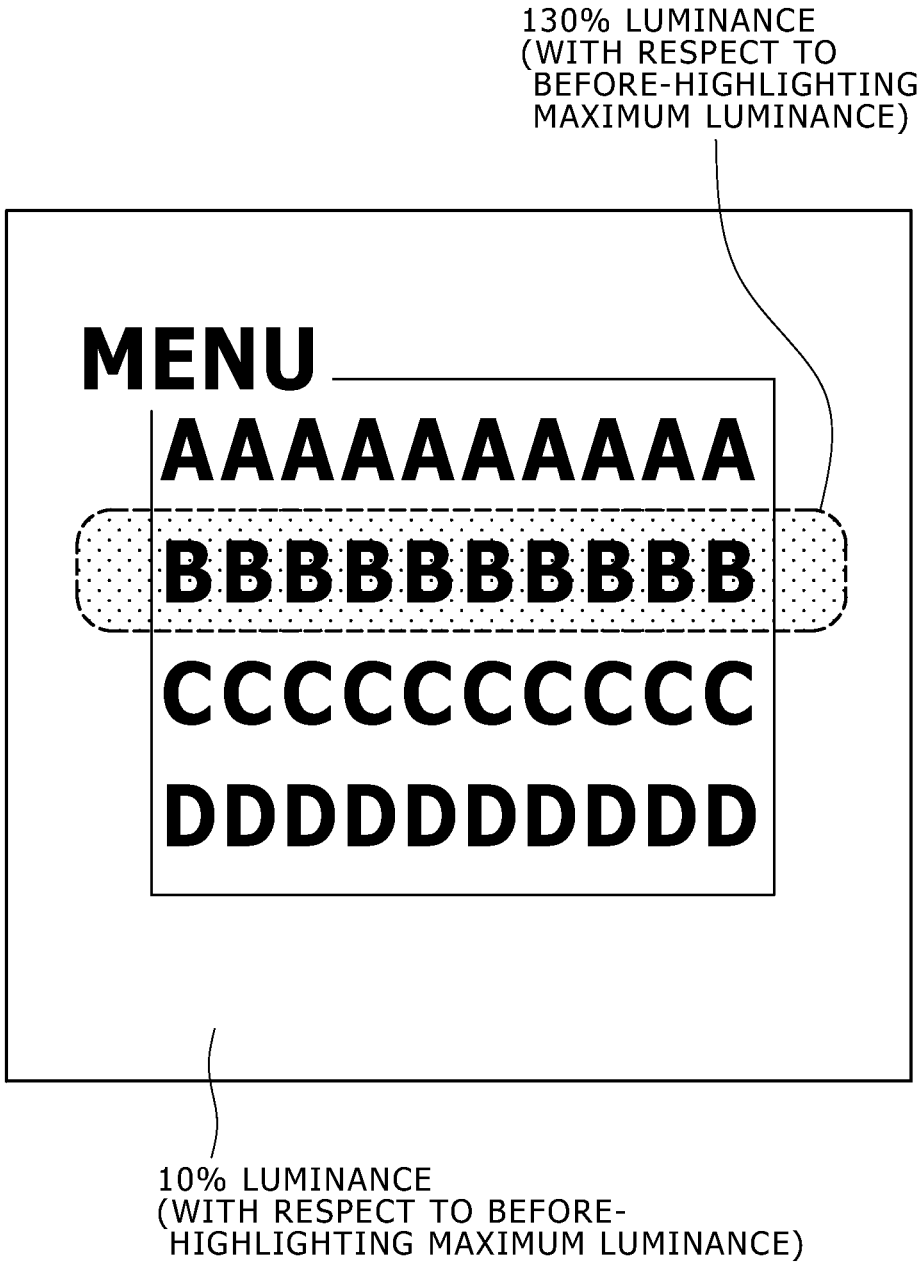
FIG. 20 is a diagram showing an example of highlighting of a character part when a part of a screen is defined as a highlighting area (second embodiment)

FIG. 20 shows an example of a display screen when highlighting of a character part is carried out with a partial area surrounded by the dashed line defined as a highlighting area.

In this example, the luminance of the character part surrounded by the dashed line is increased by 30% with respect to the before-highlighting maximum luminance, while the luminance of the other character part is decreased to about one-third of the before-highlighting luminance. In this case, the highlighted character part is displayed as if the one row specified in the highlighting area was irradiated with spotlight, which allows the character part to be recognized more surely.

(B-3) Advantageous Effects

As described above, using this displaying function can further enhance the contrast between a character part and a background part, which allows the character information to be recognized more easily and surely. This embodiment is more effective when there is a need to view the character information under an outdoor or bright surrounding environment in particular.

In addition, this embodiment can aggressively lower the emission luminance of a background part that occupies most of the screen compared with the before-highlighting luminance.

Therefore, the effect of power consumption decrease is achieved. If the emission luminance of a background part is significantly decreased like in this embodiment, the power consumption can be even made lower than the before-highlighting power consumption.

That is, effective reduction in power consumption can also be achieved in addition to enhancement of the visibility of a character part.

Consequently, if this displaying function is incorporated in various terminal apparatuses driven by a battery, character information can be viewed easily and a greatly increased driving time can be achieved.

When the organic EL display is supplied with power through an AC power supply, an advantageous effect of saving electrical costs can be achieved.

In addition, because lower power consumption leads to a smaller amount of heat generation, this embodiment is effective also for reduction in costs of the entire device including a heat sink.

(C) Other Embodiments (a) In the above-described embodiments, the entire screen is collectively subjected to grayscale conversion by the image quality converter, and then the subsequent-stage image quality selector selectively outputs either one of the before-conversion grayscale values and the after-conversion grayscale values.

Figure 21:
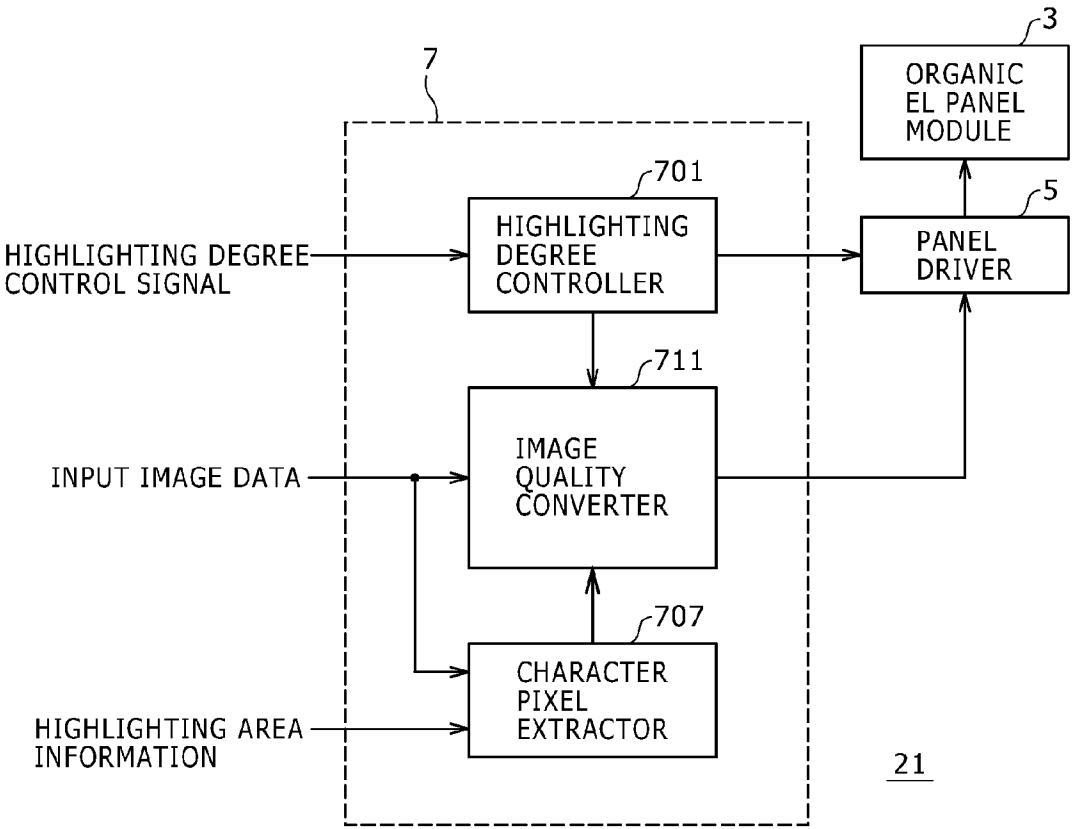
FIG. 21 is a diagram showing another functional configuration example of an organic EL display.

Alternatively, a configuration like an organic EL display 21 shown in FIG. 21 is also available. Specifically, in this display 21, the function to switch the image quality is implemented in an image quality converter 711.

In this example, the image quality converter 711 executes image conversion processing different for each pixel based on a highlighting area switch signal supplied from a character pixel extractor 707.

Specifically, for a character part, the image quality converter 711 outputs the grayscale values of input image data as they are. For a background part, the image quality converter 711 subjects the grayscale values of the input image data to gamma conversion so that the maximum luminance may be decreased. This system configuration can also offer the same advantages as those by the above-described embodiments.

(b) In the above-described embodiments, a menu screen is shown as an example of a screen in which a highlighting area is specified in linkage with displayed content of an application program. For example, the function to highlight a character part may be used for an entity representing an operation target, such as a button, icon, or title bar. That is, a specific button, icon, or the like may be highlighted as a character part.

Figure 22A:
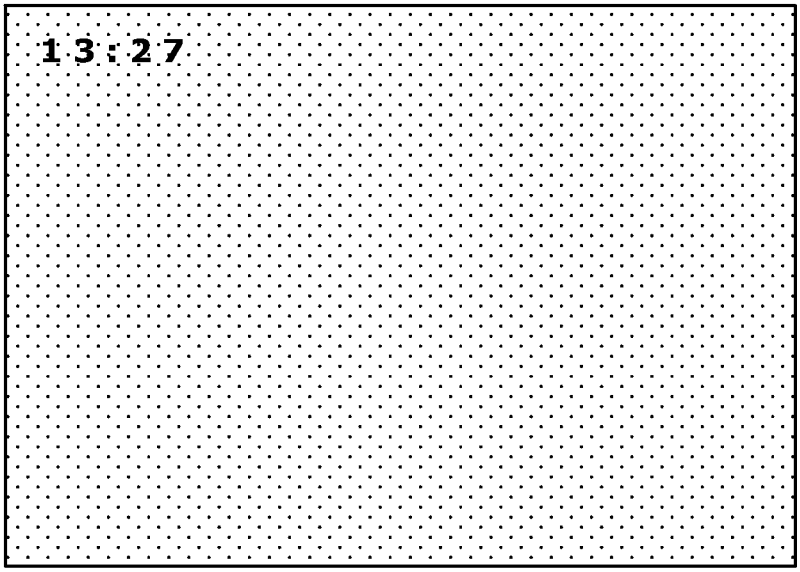
FIGS. 22A and 22B are diagrams for explaining other examples of specifying of a highlighting area.
Figure 22B:
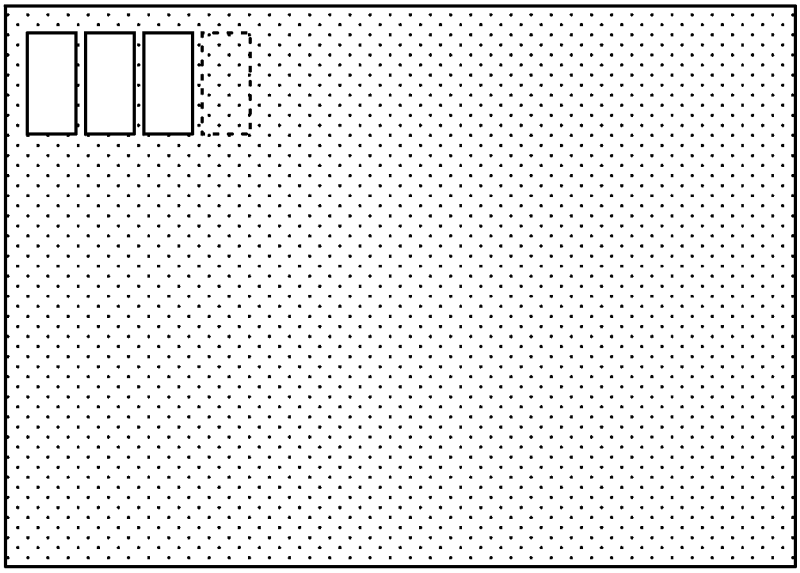

Furthermore, as shown in FIG. 22A, a numeric part may be highlighted in a screen indicating the time. In addition, as shown in FIG. 22B, a symbol part may be highlighted in a screen indicating a remaining battery capacity.

That is, a pattern indicating the time or a remaining battery capacity may be highlighted as a character part.

(c) In the above-described embodiments, an organic EL display is shown as one example of a self-luminous display. However, the embodiment can be applied also to other self-luminous displays. Specifically, the embodiment can be applied also to e.g. field emission displays (FEDs), inorganic EL displays, and LED panels.

Furthermore, the highlighting technique of the embodiment can be applied not only to self-luminous displays but also to various non-self-luminous displays. For example, the embodiment can be applied to a liquid crystal panel display.

In the case of a liquid crystal display, the panel driver 5 executes control operation for increasing the light amount of a backlight light source based on a highlighting degree signal.

When the embodiment is applied to a non-self-luminous display, the display is difficult to achieve the effects of minimization of power consumption increase and aggressive power saving.

However, similarly to a self-luminous display, the non-self-luminous display will also achieve the advantage of enhancing the visibility of a character part by increasing the emission luminance of the character part to thereby increase the contrast between the character part and a background part.

(d) In the above-described embodiments, the function to selectively increase the emission luminance of a character part is incorporated in an organic EL display.

However, this function to selectively increase the emission luminance of a character part can be incorporated in various electronic apparatuses that include or control a self-luminous display.

Examples of the electronic apparatuses include a computer, printing device, video camera, digital camera, game apparatus, portable information terminal (portable computer, cell phone, portable game apparatus, electronic book, etc.), clock, image reproducing device (e.g., optical disc device and home server).

Each of the electronic apparatuses includes a case, signal processor (MPU), and external interface as its common configuration, and is combined with a peripheral device dependent upon its product form.

For example, a cell phone or another electronic apparatus having a communication function includes a transmission/reception circuit and antenna in addition to the above-described components.

Figure 23A:
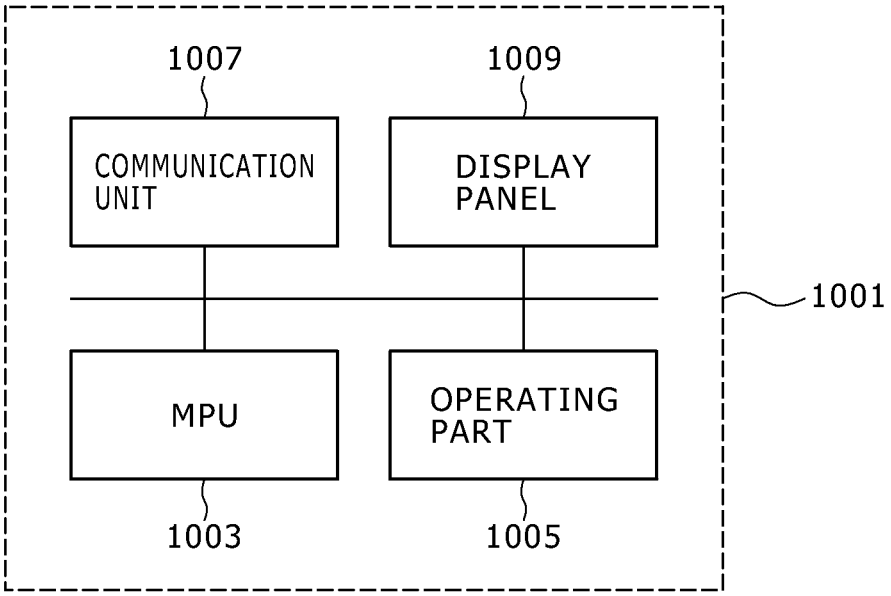
FIGS. 23A and 23B are diagrams for explaining examples of application to another electronic apparatus.

FIG. 23A shows a schematic configuration example of this kind of electronic apparatus. In this example, an electronic apparatus 1001 includes a signal processor 1003, an operating part 1005, a communication unit 1007, and a display panel 1009.

Figure 23B:
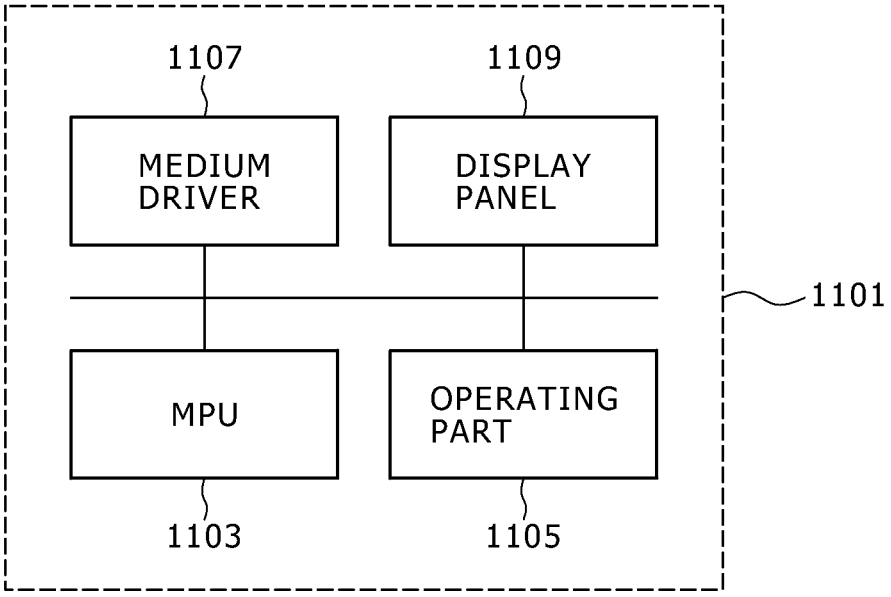

A game apparatus, electronic book or another electronic apparatus having a storage medium includes a drive circuit for the storage medium and so on in addition to the above-described components. FIG. 23B shows a schematic configuration example of this kind of electronic apparatus. In this example, an electronic apparatus 1101 includes a signal processor 1103, an operating part 1105, a medium driver 1107, and a display panel 1109.

Figure 24A:
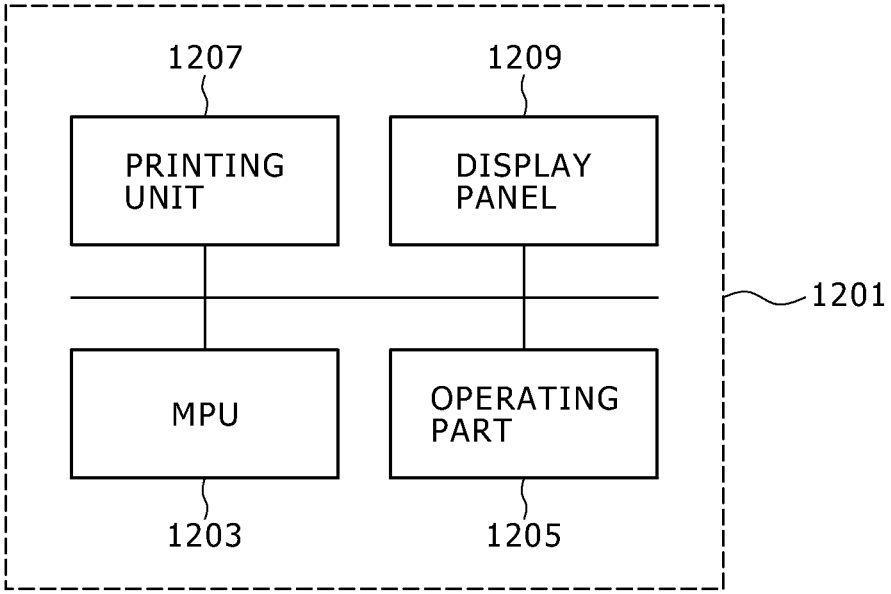
FIGS. 24A and 24B are diagrams for explaining examples of application to another electronic apparatus.

A printing device includes a printing unit in addition to the above-described components. As the printing unit, the optimum unit is incorporated depending on the printing method. Examples of the printing method include a laser method and an inkjet method. FIG. 24A shows a schematic configuration example of this kind of electronic apparatus.

In this example, an electronic apparatus 1201 includes a signal processor 1203, an operating part 1205, a printing unit 1207, and a display panel 1209.

A video camera or digital camera includes in addition to the above-described components a camera unit and a write circuit for storing captured video data in a storage medium.

Figure 24B:
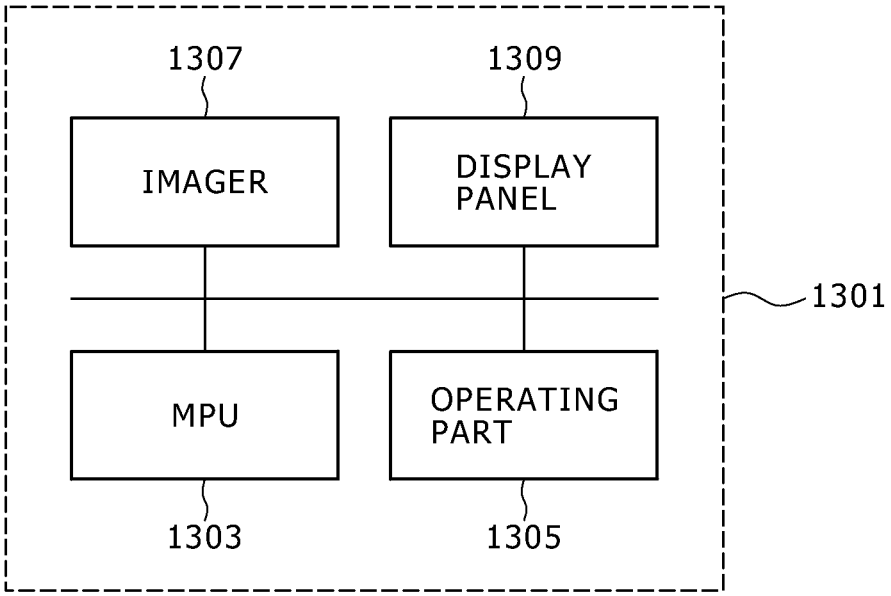

FIG. 24B shows a schematic configuration example of this kind of electronic apparatus.

In this example, an electronic apparatus 1301 includes a signal processor 1303, an operating part 1305, an imager 1307, and a display panel 1309.

It should be obvious that when an electronic apparatus including a battery is provided with the function to allow selective highlighting of a character part, the driving time of the apparatus can be extended.

In addition, when an electronic apparatus employing an electrical outlet is provided with the function to selectively increase the emission luminance of a character part, the electrical costs can be saved.

(e) In the above description of the embodiments, the technique that allows selective highlighting of a character part has been explained from a functional standpoint. It will be obvious that the equivalent function can be realized both by hardware and by software.

All of these processing functions may be realized by one of hardware and software. Alternatively, a part of the functions may be realized by the other of the hardware and software. That is, a combination between hardware and software is also available.

(f) Various modifications might be incorporated in the above-described embodiments without departing from the scope of the present invention. In addition, various modifications and applications that are created or combined based on the description of the present specification are also available.

What is claimed is:

1. A display apparatus comprising:

a display panel including a plurality of self-luminescent pixel elements;

a control circuitry configured to receive an input data including an image data, convert at least a part of the input data to a converted image data, and selectively outputs, to each of the pixel elements, (i) a first image signal based on the input data for the pixel elements corresponding to a specific part, and (ii) a second image signal based on the converted image data for the pixel elements corresponding to a background part;

wherein the control circuitry is configured to decrease grayscale values of said at least a part of the input data for the pixel elements corresponding to the background part, such that an emission luminance of a display screen corresponding to the specific part is higher than an emission luminance of the display screen corresponding to the background part.

2. The display apparatus according to claim 1, wherein the specific part is a character part.

3. The display apparatus according to claim 2, wherein the specific part is a character part within a menu screen for controlling an operation target.

4. The display apparatus according to claim 1, wherein the specific part is a part corresponding to a feature selected from a group consisting of a button, an icon, and a title bar.

5. The display apparatus according to claim 1, wherein the control circuitry is configured to decrease grayscale values of said at least a part of the input data for the pixel elements corresponding to the background part, by a predetermined percentage.

6. The display apparatus according to claim 1, wherein the control circuitry is configured to convert the image data corresponding to the background part so as to decrease grayscale values, while converting the image data corresponding to the specific part so as to increase an emission luminance in the display screen.

7. The display apparatus according to claim 6, wherein the control circuitry is configured to convert the image data such that an amount of the increase of power consumption in the pixel elements corresponding to the specific part is lower than an amount of the decrease of power consumption in the pixel elements corresponding to the background part.

8. The display apparatus according to claim 1, wherein the control circuitry is configured to extract the pixel region corresponding to the specific part based on grayscale value of the image data.

9. The display apparatus according to claim 8, wherein the control circuitry is configured to extract the pixel region corresponding to the specific part by comparing grayscale difference with respect to a previous pixel in a transmission order based on the input data.

10. The display apparatus according to claim 1, wherein the control circuitry includes:

an image processing circuitry configured to convert said at least a part of the input data; and a panel driver configured to selectively output one of the first image signal or the second image signal to each of the pixel elements.

11. The display apparatus according to claim 5, wherein each of the self-luminescent pixel elements includes:

an organic EL element;

a sampling transistor configured to sample data voltage corresponding to one of the first image data and the second image data; and a drive transistor configured to supply a current to the organic EL element from a power supply line, in response to the data voltage.

12. The display apparatus according to claim 11, wherein each of the self-luminescent pixel elements further includes:

a switch transistor configured to switch the current to the organic EL element from the power supply line.

13. The display apparatus according to claim 12, wherein the control circuitry is configured to variably control a turn-on duration of the switch transistor in each of the pixel elements.

14. The display apparatus according to claim 11, wherein, when the input data includes a data corresponding to a plurality of character parts, the control circuitry is configured to select at least one of the character parts as the specific part to be highlightened.

15. The display apparatus according to claim 14, wherein, when the input data includes a data corresponding to a plurality of character parts, the control circuitry is configured to select the character parts within a specific line as the specific part.

16. The display apparatus according to claim 12, wherein the control circuitry includes:

an image processing circuitry configured to convert said at least a part of the input data; and a panel driver configured to selectively output one of the first image signal or the second image signal to each of the pixel elements.

17. The display apparatus according to claim 16, wherein the panel driver is configured to output control pulses for the switch transistor and the sampling transistor in each of the pixel elements.

18. An electronic apparatus comprising the display device according to claim 1.

19. The electronic apparatus according to claim 18, wherein the electronic apparatus is an apparatus selected from a group consisting of a computer, a printing device, a video camera, a digital camera, a game apparatus, a portable information terminal, a clock and an image reproducing device.

20. The electronic apparatus according to claim 18, further comprising a battery configured to provide power for the display panel.

* * * * *